US012767191B2

(12) United States Patent
Nilsson

(10) Patent No.: US 12,767,191 B2
(45) Date of Patent: Oct. 20, 2026

(54) COUPLER WITH ANGULAR POSITION DETECTION ASSEMBLY, ANGULAR POSITION DETECTION SYSTEM AND METHOD

(71) Applicant: DELLNER COUPLERS AB, Falun (SE)

(72) Inventor: Marcus Nilsson, Falun (SE)

(73) Assignee: DELLNER COUPLERS AB, Falun (SE)

( * ) Notice: Subject to any disclaimer, the term of this patent is extended or adjusted under 35 U.S.C. 154(b) by 436 days.

(21) Appl. No.: 18/290,524

(22) PCT Filed: May 9, 2022

(86) PCT No.: PCT/SE2022/050451
§ 371 (c)(1),
(2) Date: Nov. 14, 2023

(87) PCT Pub. No.: WO2022/245268
PCT Pub. Date: Nov. 24, 2022

(65) Prior Publication Data

US 2024/0246580 A1 Jul. 25, 2024

(30) Foreign Application Priority Data

May 20, 2021 (SE) ..... 2150646-4

(51) Int. Cl.
*B61G 3/20* (2006.01)
*B61G 7/12* (2006.01)
(Continued)

(52) U.S. Cl.
CPC ..... *B61G 3/20* (2013.01); *B61G 7/12* (2013.01); *B61G 9/00* (2013.01); *B61L 15/0081* (2013.01)

(58) Field of Classification Search
CPC ... B61G 3/16; B61G 3/20; B61G 7/12; B61G 9/00; B61L 15/0081
See application file for complete search history.

(56) References Cited

U.S. PATENT DOCUMENTS 3,750,774 A * 8/1973 Trapp ..... B62D 55/108 280/124.168
3,774,775 A * 11/1973 Allen ..... B61G 7/06 213/15

(Continued)

FOREIGN PATENT DOCUMENTS

CA 2901176 A1 * 9/2014 ..... B61G 7/12
CN 107672618 A 2/2018

(Continued)

*Primary Examiner* — Jason C Smith
(74) *Attorney, Agent, or Firm* — Dilworth & Barrese, LLP

(57) ABSTRACT

The present invention relates to a coupler with an angular position detection assembly, the coupler (10, 10', 10") comprising: —a front part (11), —a rear part (12), —a rotatable joint (20) comprising a first portion (21, 23) and a second portion (22, 24), said first portion (21, 23) being rotatably attached to the second portion (22, 24), wherein the first portion (21, 23) is attached to the front part (11) and the second portion (22, 24) is attached to the rear part (12) so that the front part (11) of the coupler is rotatable in relation to the rear part (12), and the angular position detection assembly (30) comprising: —a first sensor (31) arranged in connection with one of the first portion (21, 23) and the second portion (22, 24) of the joint (20) and configured to detect or measure a parameter indicative of an angular position of the first portion (21, 23) in relation to the second portion (22, 24), —a transmitter (32) for receiving signals and transmitting them to processing circuitry (40).

14 Claims, 14 Drawing Sheets

Figure 1B:
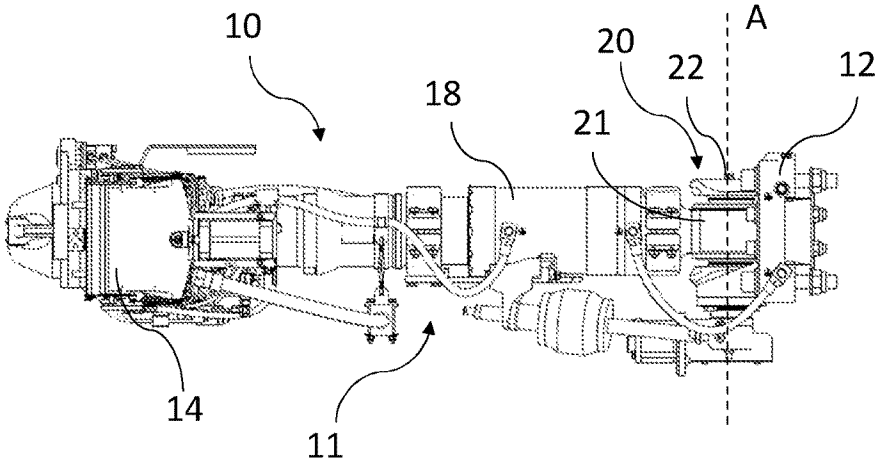

(51) Int. Cl.
*B61G 9/00* (2006.01)
*B61L 15/00* (2006.01)

(56) References Cited

U.S. PATENT DOCUMENTS

| | | | | | |
|---|---|---|---|---|---|
| 5,841,132 | A * | 11/1998 | Horton | G01D 5/347 | 341/13 |
| 5,927,522 | A * | 7/1999 | Carifa | B61G 3/06 | 213/170 |
| 8,091,717 | B2 * | 1/2012 | Sprave | B61G 7/08 | 213/18 |
| 9,707,979 | B2 * | 7/2017 | McMillen | B61G 3/06 | |
| 11,370,466 | B2 * | 6/2022 | Schipmann | B61G 7/12 | |
| 2012/0037586 | A1 * | 2/2012 | Dumey | B61G 3/04 | 213/155 |
| 2015/0375762 | A1 * | 12/2015 | Mautino | B61G 3/06 | 213/155 |
| 2017/0151965 | A1 * | 6/2017 | Brooks | G06Q 10/20 | |
| 2017/0197640 | A1 * | 7/2017 | Koch | E05F 15/00 | |
| 2018/0162423 | A1 * | 6/2018 | Zhang | B61G 7/14 | |
| 2023/0234624 | A1 * | 7/2023 | Knaus | B61G 7/12 | |
| 2023/0406371 | A1 * | 12/2023 | Kinghorn | B61G 7/10 | |
| 2024/0246580 | A1 * | 7/2024 | Nilsson | B61G 3/20 | |

FOREIGN PATENT DOCUMENTS

| | | | | | |
|---|---|---|---|---|---|
| CN | 207741730 | U | | 8/2018 | |
| CN | 209382010 | U | * | 9/2019 | |
| CN | 110342431 | A | | 10/2019 | |
| CN | 110831791 | A | | 2/2020 | |
| DE | 2419184 | | * | 11/1975 | |
| DE | 102015122863 | A1 | * | 6/2017 | B61G 9/06 |
| EP | 2366563 | A2 | | 9/2011 | |
| EP | 3750774 | A1 | | 12/2020 | |
| EP | 4178844 | B1 | * | 7/2025 | B61G 7/02 |
| JP | 7220541 | B2 | * | 2/2023 | |
| KR | 20210000790 | A | * | 1/2021 | B61G 7/12 |
| KR | 20260031961 | A | * | 3/2026 | E04G 23/0203 |
| WO | 2014153497 | A1 | | 9/2014 | |
| WO | 2016/131716 | A1 | | 8/2016 | |
| WO | WO-2018077752 | A1 | * | 5/2018 | B61G 7/12 |

* cited by examiner

COUPLER WITH ANGULAR POSITION DETECTION ASSEMBLY, ANGULAR POSITION DETECTION SYSTEM AND METHOD

TECHNICAL FIELD

The present invention relates to a coupler for a railway vehicle with an angular position detection assembly for detecting a pivoting of a front part of the coupler in relation to a rear part of the coupler. The invention also relates to an angular position detection system with processing circuitry for determining an angular position of the front part of the coupler, and to a corresponding method.

BACKGROUND

Couplers for railway vehicles are used for connecting one car of a train to another. Typically, a coupler comprises a rear part that is mounted on a car and a front part that is intended for coupling to a similar coupler mounted on another car. The front part contains at least a mechanical coupler but often also other kinds of couplers (electrical, pneumatical).

The front part and the rear part of the coupler are joined in a pivotable joint that allows an angular displacement of the front part in relation to the rear part. This is both a great advantage during operation of the train, since it allows a curvature of the train to accommodate curves along the tracks, and a benefit during coupling of one coupler to another in situations where they are not suitably aligned for coupling to each other, since their respective positions may be adjusted by pivoting the front ends of the coupler. Any attempts to couple couplers that are not aligned properly may cause transversal forces that can hinder the coupling altogether or in extreme cases result in derailing of the car on which the coupler is mounted.

In some couplers the joint between the front part and the rear part also allows pivoting the front part to a stowing position where it may be securely held when not in use.

During operation of the train the front part of the couplers pivot repeatedly and this eventually causes wear to the joint. There are also other structures that must pivot along with the couplers, such as gangways that allow passengers to move from one car into another, and similar to the coupler itself the repeated pivoting movement in itself causes wear that sometimes leads to the need for repair or replacement.

Both for coupling and stowing a coupler and for operation of a train comprising couplers for joining railway cars to each other, it is advantageous to be able to detect an angular displacement or angular position of the front part of the coupler. There are some prior art that shows solutions within this area, but they are mostly cumbersome and unreliable. One example of a prior art solution is shown by CN209382010U.

Since the coupler and its immediate surroundings is generally a dirty and demanding environment with vibrations that occur during movement of the train, any components placed in connection with the coupler will also be subjected to significant wear and will have a limited lifetime for this reason. Repair and replacement is costly since the coupler generally needs to be taken out of service for this purpose, so it is for this reason especially desirable to avoid easily damaged components that must be placed in areas where vibrations and dirt may cause malfunction.

There is a therefore need for improvements within this area where the angular position of the front part of the coupler can be determined in an efficient and reliable way.

SUMMARY

The object of the present invention is to eliminate or at least to minimize the problems discussed above. This is achieved by a coupler with an angular position detection assembly, an angular position detection system, a method, and a non-transitory computer-readable storage medium according to the description herein. It is also achieved by a centering device according to the description herein. Other advantages of the invention are set out in the description herein.

The coupler with an angular position detection assembly is suitable for determining an angular displacement of a front part of the coupler. The coupler comprises a front part for coupling to another coupler, a rear part for mounting on an end of a car of a railway vehicle, and a rotatable joint comprising a first portion and a second portion, said first portion being rotatably attached to the second portion. The first portion of the joint is attached to the front part and the second portion of the joint is attached to the rear part so that the front part of the coupler is able to rotate in relation to the rear part. The angular position detection assembly comprises

- a first sensor arranged in connection with one of the first portion and the second portion and configured to detect or measure a parameter indicative of an angular displacement of the first portion in relation to the second portion, and
- a transmitter configured to receive signals from the first sensor and further configured to transmit said signals to processing circuitry for determining the angular position of the front part of the coupler in relation to the rear part of the coupler.

One main benefit of the present invention is that the angular position of the front part of the coupler can be measured or detected in a very convenient and reliable way, and requiring only one sensor. Since the rotatable joint allows the front part to swivel in relation to the rear part, detecting or measuring the rotation in the joint gives sufficient information to find out the orientation of the front part. By providing the transmitter connected to the first sensor, signals may be transmitted to processing circuitry.

In some embodiments, the joint is an elastomer spring joint, EFG, and the first sensor is configured to detect or measure a parameter indicative of an angular position in a plane of rotation that is perpendicular to a first axis. Thereby, the pivoting movement in the elastomer spring joint, that typically takes place in both a horizontal and a vertical plane of rotation, may be isolated so that the angular position in one plane of rotation, suitably a horizontal plane of rotation, is determined. This is advantageous in a number of applications as will be described in detail below in the detailed description. Determining the horizontal angular position is important both when deciding if a coupling to another coupler can take place and in a plurality of circumstances during operation of a railway vehicle to which the coupler is mounted.

Also, when the joint is an elastomer spring joint, EFG, the first sensor may be configured to detect or measure a parameter indicative of an angular position in a plane of rotation that is perpendicular to a second axis. This is also advantageous in a number of applications as will be described in the detailed description. Such applications include when deciding if a coupling to another coupler may take place.

In another embodiment the joint comprises a joint head and a pivot pin held by a holder, the joint head being arranged on the pivot pin to rotate about a first axis and one of the joint head and the pivot pin forming the first portion of the joint and the other of the joint head and the pivot pin forming the second portion of the joint. The first sensor is arranged in connection with one of the joint head and the pivot pin and configured to detect or measure a rotation about the first axis of the joint head in relation to the pivot pin. Thereby, the angular position in a plane may be determined, said plane typically being a horizontal plane when the coupler is in use mounted on a railway vehicle.

The first sensor may be configured to detect at least one marker on a marking surface, wherein the first sensor is arranged on one of the first portion and the second portion and the marking surface is a surface on the other of the first and second portion, said marking surface being arranged to face the first sensor. This is a very easy and convenient yet still reliable way of detecting or measuring the angular displacement, since it only requires a marking surface on one of the first and the second portion and a first sensor on the other. The first sensor may preferably be an optical sensor.

Suitably, the angular position detection assembly may comprise a curved surface mounted on one of the first portion and the second portion, and the first sensor may be mounted on the other of the first and second portion.

The curved surface may be arranged so that a distance between the first sensor and a closest point on the curved surface in a radial direction varies when the first portion rotates in relation to the second portion, said radial direction being a direction that is perpendicular to a rotational axis of the joint, and the first sensor may further be configured to detect or measure a distance from the first sensor to the curved surface. Thereby, a convenient and reliable way of detecting or measuring the angular position is achieved.

In some embodiments, the curved surface forms an edge of a cam disk that is fixedly mounted on the pivot pin, and the first sensor is mounted facing the edge of the cam disk on a structure connected to the joint head. This is a very robust and cost-efficient way of detecting or measuring the angular position. Also, there may be at least two sensors, the first sensor and an additional sensor, that are each mounted on the structure facing the edge of the cam disk, and the at least two sensors may be at a distance from each other in a circumferential direction around the pivot pin. This further increases reliability and also increases the range of angular position that may be measured or detected by the two or more sensors e.g. being able to measure within different angular ranges.

In some embodiments, the coupler further comprises at least one centering device that is arranged in connection with the joint head of the joint, said at least one centering device comprising a contact element that is biased towards the pivot pin of the joint in a radial direction of the pivot pin. The contact element is at a variable distance from a center of the pivot pin depending on an angular position of the pivot pin in relation to the joint head, and the first sensor of the angular position detection assembly is configured to detect or measure a parameter that is indicative of a radial position of the contact element. This is particularly advantageous since the angular position is determined or measured by finding out the position of the contact element. It is a very reliable and sturdy embodiment, especially since the first sensor is protected by the centering device so that wear or damage to the first sensor is minimized. The configuration of the first sensor in the centering device also enables measuring or detecting the angular position with high accuracy over a long period of time.

Also, in an embodiment having a centering device, a surface of the pivot pin may comprise at least one recess and the contact element of the centering device may be rotatably or slidably arranged to remain in contact with said surface as one of the pivot pin and the joint head rotates in relation to the other. This is an advantageous way of centering the pivot pin and allows for the first sensor measuring or detecting the position or the displacement of the contact element as it slides or rotates into and out of the recess.

In an embodiment comprising the centering device, the centering device may also comprise at least one piston that is configured to push against the contact element in the radial direction, and the first sensor may be configured to detect or measure the radial position of the contact element by detecting or measuring a parameter that is indicative of a radial position of the piston. Thereby, determining the radial position of the piston allows for a very robust and reliable way of finding out the position of the contact element and thereby of the rotation of the joint head in relation to the pivot pin. The first sensor may be configured to detect or measure a position of the piston. This is a straightforward and convenient way. Alternatively, the first sensor is configured to detect or measure an internal pressure in a chamber of the piston or of a housing in which the piston is arranged. This is a reliable way and has the advantage of protecting the first sensor by arranging it inside or in connection with the chamber or housing.

In some embodiments with a centering device, there may be at least one biasing spring for biasing the contact element towards the pivot pin, and the first sensor may be configured to detect or measure at least one property of the at least one biasing spring. This is a convenient and reliable way that gives the position of the contact element with high precision.

In some embodiments, there may also be an additional centering device that is arranged in connection with the joint head, said at least one additional centering device comprising a contact element that is biased towards the pivot pin in a radial direction of the pivot pin, wherein the contact element is at a variable distance from a center of the pivot pin depending on an angular position of the pivot pin in relation to the joint head, and wherein the first sensor of the angular position detection assembly is configured to detect or measure a parameter that is indicative of a radial position of the contact element of the additional centering device. Thus, by using at least two centering devices that each comprise at least one first sensor for measuring or detecting the position of a contact element, higher accuracy when determining the rotation of the pivot pin may be achieved. Also, the contact elements may have different dimensions, and/or recesses in the pivot pin into which the contact elements fit may have different width and/or inclination, so that an angular range in which rotation can be measured is increased. Also, the centering devices may be suited to center the pivot pin in relation to the joint head from larger angular deviations when dimensions of the contact elements and recesses are varied in this way.

The present invention also relates to an angular position detection system comprising a coupler with an angular position detection assembly according to the invention. The system also comprises processing circuitry operatively connected to the transmitter of the first sensor of the angular position detection assembly for receiving at least one signal indicative of the detected or measured parameter, and the processing circuitry is further configured to receive, from the first sensor, at least one input signal indicative of an angular position of the first portion of the joint in relation to the second portion of the joint, and to determine, based on said at least one input signal, an angular position of the front part of the coupler in relation to the rear part of the coupler. One particular advantage of the system according to the invention is that it combines the feature of the coupler with the angular position detection assembly with processing circuitry so that the system is able to determine an orientation of the coupler based on the measurements made by the first sensor.

The present invention also encompasses a method for determining an angular position of a front part of a coupler, the method comprising providing a coupler comprising a front part for coupling to another coupler, a rear part for mounting on an end of a car of a railway vehicle, and also comprising a rotatable joint, wherein the rotatable joint comprises a first portion and a second portion, said first portion being rotatably attached to the second portion, wherein the first portion of the joint is attached to the front part and the second portion of the joint is attached to the rear part so that the front part of the coupler is able to rotate in relation to the rear part, providing a first sensor arranged in connection with one of the first portion and the second portion, measuring or detecting, by the first sensor, a parameter indicative of an angular position of the first portion of the joint in relation to the second portion of the joint.

Thereby, the main benefit of the present invention may be achieved, namely that the angular position of the front part of the coupler can be measured or detected in a very convenient and reliable way, needing only one sensor.

In some embodiments, the method also comprises providing processing circuitry operatively connected to the first sensor for receiving signals from the first sensor, and the method also comprising receiving, in processing circuitry, at least one input signal from the first sensor indicative of an angular position of the first portion of the joint in relation to the second portion of the joint, and determining, based on said at least one input signal, an angular position of the front part of the coupler in relation to the rear part of the coupler. Thereby, the angular position of the front part of the coupler may be determined in a convenient and reliable way.

Suitably, the method also comprises providing at least two sensors that comprise at least one first sensor and at least one second sensor, measuring or detecting, by said at least one first sensor, a parameter indicative of an angular position of the first portion in a plane of rotation that is perpendicular to a first axis, measuring or detecting, by said at least one second sensor, a parameter indicative of an angular position of the first portion in a plane of rotation that is perpendicular to a second axis, said second axis being perpendicular to the first axis, receiving, in processing circuitry, at least one first input signal from the at least one first sensor and at least one second input signal from the at least one second sensor, wherein said first and second input signals are indicative of the measured or detected parameter from the first sensor and the second sensor, determining, in processing circuitry, based on said at least one first input signal and said at least one second input signal, a combined angular position in relation to the first and the second axes of rotation of the front part of the coupler in relation to the rear part of the coupler.

This has the advantage of combining angular position in two dimensions into one combined angular position so that the orientation of the front part of the coupler can be determined. It is particularly advantageous in embodiments where the coupler comprises an elastomer spring joint since any swiveling of the front part of the coupler in such joints is allowed to take place in a horizontal direction, a vertical direction, or any combination thereof.

Also, in some embodiments the method may further comprise receiving, in processing circuitry, from either the at least one sensor or the at least one first sensor and the at least one second sensor, input signals indicative of an angular position at a plurality of time instances, determining, in processing circuitry, an angular position of the front part of the coupler over time based on said input signals.

Thereby, not only the orientation of the coupler at any given time can be determined, but also how that orientation has changed over time. This is particularly beneficial in a number of applications, including when a correction of an angular position is made since the correction can be adapted so that a swiveling past an intended position can be avoided or at least minimized. Correction of an angular position is thereby rendered more energy efficient and time efficient. Also, it is an advantage when assessing performance of the coupler to be able to determine angular position over time, since this allows for assessing current operation of the coupler in a shorter time span to see if repair or replacement is required, but also assessing wear and tear over longer periods of time and even to assess a lifetime of the coupler based on the angular position over time.

In some embodiments, the method may also comprise determining, in processing circuitry, based on the determined angular position or the determined combined angular position, if the front part of the coupler is in a suitable coupling position. This has the advantage of determining if a coupling will be successful even before it has taken place, and in some instances also of determining what the consequence would be if a coupling were to be attempted even though the position is not suitable. Such consequences could be serious, such as in some cases even a derailment of the vehicle on which the coupler is mounted, due to a buff stroke from the attempted coupling.

In some embodiments, the method may further comprise determining, in processing circuitry, a correction of an angular position of the front part of the coupler if the front part of the coupler is not in a suitable coupling position, and optionally, sending at least one output signal causing a pivoting means of the coupler to apply said correction to bring the front part of the coupler into a suitable coupling position. Thus, it can be determined how to correct the angular position of the front part of the coupler so that the desired coupling may take place. In some embodiments, the processing circuitry may also apply this correction using a pivoting means provided in connection with the coupler, and in other embodiments information could instead be displayed or in other ways presented to an operator that may then manually correct the angular position so that coupling may take place.

In some embodiments, the method also comprises receiving, in processing circuitry, at least one second coupler input signal indicative of an angular position of a front part of a second coupler, and determining, in processing circuitry, if the front part of the second coupler is in a suitable coupling position based on said second coupler input signal. In this way, information in the form of a signal from a sensor on the second coupler to which the coupler is to be coupled, or a signal from processing circuitry or from any other source of information, may be received by the processing circuitry of the present invention. The processing circuitry may also determine if the coupler and the second coupler are in a suitable coupling position in relation to each other. By thus being able to determine orientation of both the coupler and the second coupler, it may even more accurately be determined if their respective positions are suitable for coupling them to each other.

In some embodiments, the method may also comprise determining, in processing circuitry, a correction of an angular position of the front part of the coupler and/or the front part of the second coupler, and optionally, sending at least one output signal causing a pivoting means of the coupler and/or a pivoting means of the second coupler to apply said correction to bring the front part of the coupler and/or the front part of the second coupler into a suitable coupling position in relation to each other. Thus, the processing circuitry may not only determine the angular positions of the couplers and their suitability for coupling at the given time, but it may also apply corrections to their relative positions so that the coupling can then take place in the desired way. This is also particularly advantageous for minimizing the risk that a buff stroke from a misaligned coupling could cause damage or even derailment, and it is also advantageous when desiring to couple two couplers to each other in a location where it is unsuitable for operators to manually correct the positions of the couplers due to safety reasons or other reasons.

Furthermore, the method may also comprise determining, in processing circuitry, at least one wear related parameter of the coupler based at least partly on the angular position of the front part of the coupler over time. Thereby, wear on the coupler may be made known and/or monitored over time, and future repair or replacement may also be scheduled based on the determined wear related parameter.

In some embodiments, the method may also comprise determining, in processing circuitry, the at least one wear related parameter of the coupler based at least partly on a rate of change of the angular position over time. This is particularly advantageous since it is able to take into account that the wear on the coupler not only depends on the angular positions as such but also on the speed at which displacements take place. For instance, a number of fast swiveling movements would cause more wear than a number of slower swiveling movements, and by determining the rate of change of the angular position this can be used to determine the wear even more accurately.

In some embodiments, the method may also comprise determining, in processing circuitry, at least one wear related parameter of a pivotable component that is mounted on the coupler based at least partly on the angular position over time or the rate of change of the angular position over time, wherein said pivotable component is preferably a gangway. This is particularly advantageous since it allows for assessing damage to such pivotable components and the wear related parameter may then be used to schedule repair and/or replacement of these components as well.

In some embodiments, the method also comprises determining, in processing circuitry, if the front part of the coupler is in a stowage position based at least partly on the determined angular position. This is particularly advantageous for folding couplers where the front part of the coupler is folded for stowage when not in use. By determining that the angular position of the front part corresponds to the stowage position, it can be ascertained that correct stowage is achieved so that undesired swiveling or misaligning of the front part is avoided and this in turn decreases the risk of damage to the coupler and increases the lifetime of the coupler.

Suitably, the method also comprises providing a plurality of interconnected railway vehicles that are joined to each other by couplers to form a train, and providing, in each coupler of the interconnected railway vehicles, a first sensor arranged in connection with a joint rotatably connecting a front part of the coupler to a rear part of the coupler. The method then comprises measuring or detecting, by said first sensor in each coupler of the interconnected railway vehicles, a parameter indicative of an angular position of a first portion of the joint in relation to a second portion of the joint, and receiving, in processing circuitry, at least one input signal indicative of an angular position of the first portion of the joint in relation to the second portion of the joint from said first sensor for each coupler. Also, the method comprises determining, in processing circuitry, based on said at least one input signal, for each coupler an angular position of the front part of the coupler in relation to the rear part of the coupler, and determining, based on said determined angular position for each coupler, a total curvature of the train formed by the interconnected railway vehicles.

This is particularly advantageous in determining the total curvature of the train so that the angular position of each coupler may be combined and give accurate information for the entire train.

In some embodiments, the method further comprises receiving, in processing circuitry, input signals indicative of an angular position at a plurality of time instances from the first sensor of each coupler, and determining, in processing circuitry, for each coupler an angular position of the front part of the coupler over time based on said input signals, and also determining, in processing circuitry, a total curvature of the train formed by the interconnected railway vehicles over time based on said determined angular position over time for each coupler.

This is particularly advantageous in being able to track the progress of the train along the tracks and of enabling an accurate depiction of the tracks themselves so that accurate maps of a railway net may be established, or existing maps may be verified. By knowing the total curvature of the train over time, an exact location of the train may also be established when knowing the map of the tracks. Thus, the total curvature over time may be combined with other location devices such as GPS to yield a more accurate result, or the total curvature over time may replace the need for using other location devices altogether.

The present invention also relates to a non-transitory computer-readable storage medium storing instructions which, when executed by processing circuitry of the angular position detection system according to the invention, cause the angular position detection system to:

- measure or detect, by the first sensor, a parameter indicative of an angular position of the first portion of the joint in relation to the second portion of the joint,
- receive, in processing circuitry, at least one input signal from the first sensor indicative of said parameter,
- determine, based on said at least one input signal, an angular position of the front part of the coupler in relation to the rear part of the coupler.

Furthermore, the non-transitory computer-readable storage medium may also further store instruction which, when executed by the processing circuitry, cause the system to perform the method steps of the method according to the present invention.

The present invention also relates to a centering device for centering a pivot pin of a coupler for a railway vehicle. The centering device comprises a housing having an opening in a first side, a contact element that is arranged in the housing, and a biasing device configured to bias the contact element in a first direction, said first direction being a direction towards the opening in the first side so that the biasing device urges the contact element towards the opening. The centering device also comprises an angular position detection assembly comprising a first sensor that is configured to detect or measure a parameter indicative of a position of the contact element. This has the advantage of providing a conventional centering device together with the first sensor that is able to accurately determine a rotation of a pivot pin when the centering device is mounted in connection with the pivot pin itself. The advantages associated with the measuring or detection of the angular displacement of the front part of the coupler may thus be combined with the advantages of the centering device for urging the pivot pin back to a neutral position in relation to the joint head.

In some embodiments of the centering device, the biasing device comprises a piston that is configured to push against the contact element such that the contact element is biased in the first direction, and the first sensor is configured to measure or detect a parameter that is indicative of a position of the piston.

The first sensor may be configured to detect or measure an internal pressure in a chamber of the piston or of a housing in which the piston is arranged.

Also, the biasing device may comprise at least one spring for urging the contact element towards the opening, and wherein the first sensor is configured to detect or measure at least one property of the spring.

Many additional benefits and advantages of the present invention will be readily understood by the skilled person in view of the detailed description below.

DRAWINGS

Figure 1A:
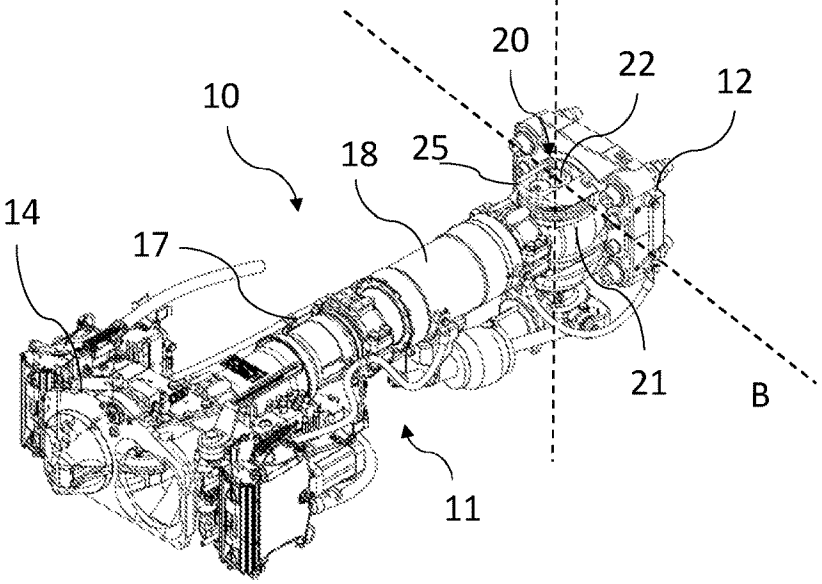

The invention will now be described in more detail with reference to the appended drawings, wherein FIG. 1*a* discloses a perspective view of a coupler of a first type having a joint with a joint head and a pivot pin mounted on a holder;

FIG. 1*b* discloses a planar view from the side of the coupler of FIG. 1*a;*

Figure 2B:
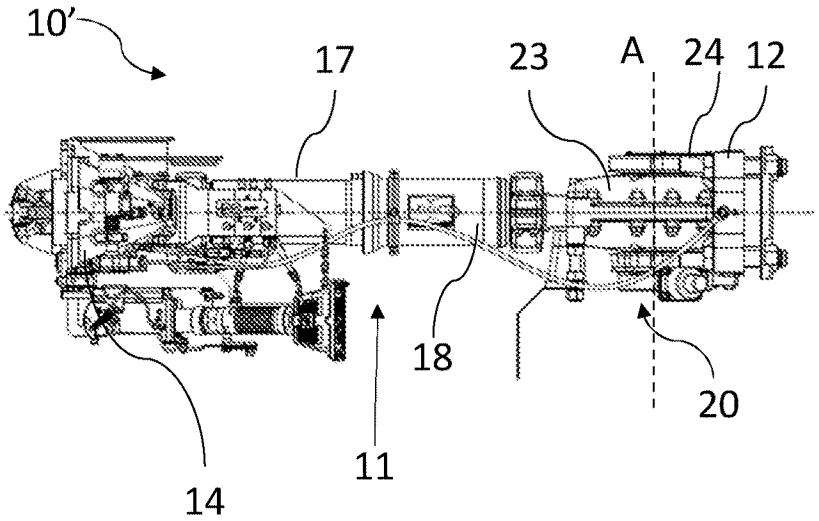
Figure 2A:
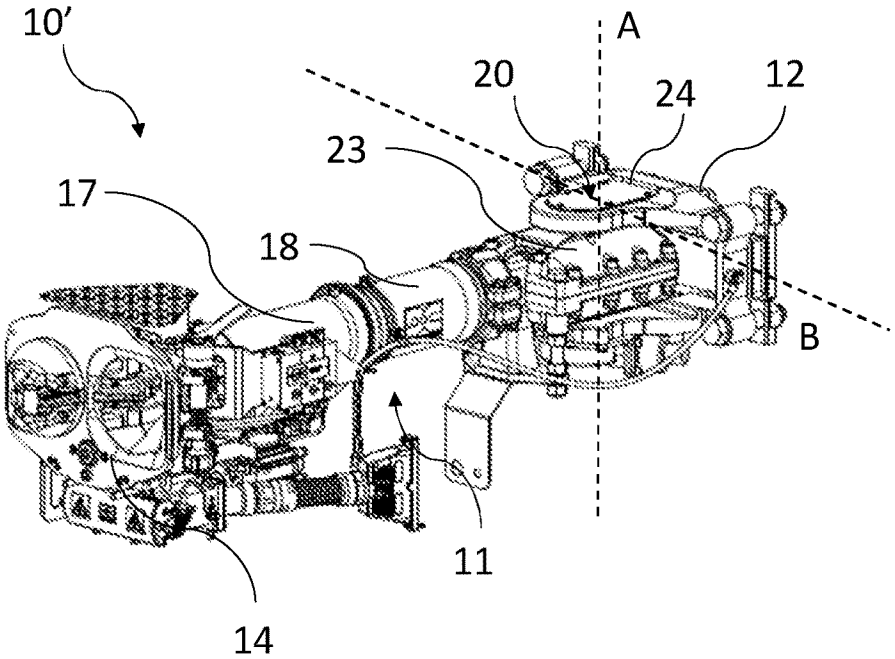

FIG. 2*a* discloses a perspective view of a coupler of a second type having a joint in the form of an elastomeric spring joint;

FIG. 2*b* discloses a planar view from the side of the coupler of FIG. 2*a;*

Figure 3B:
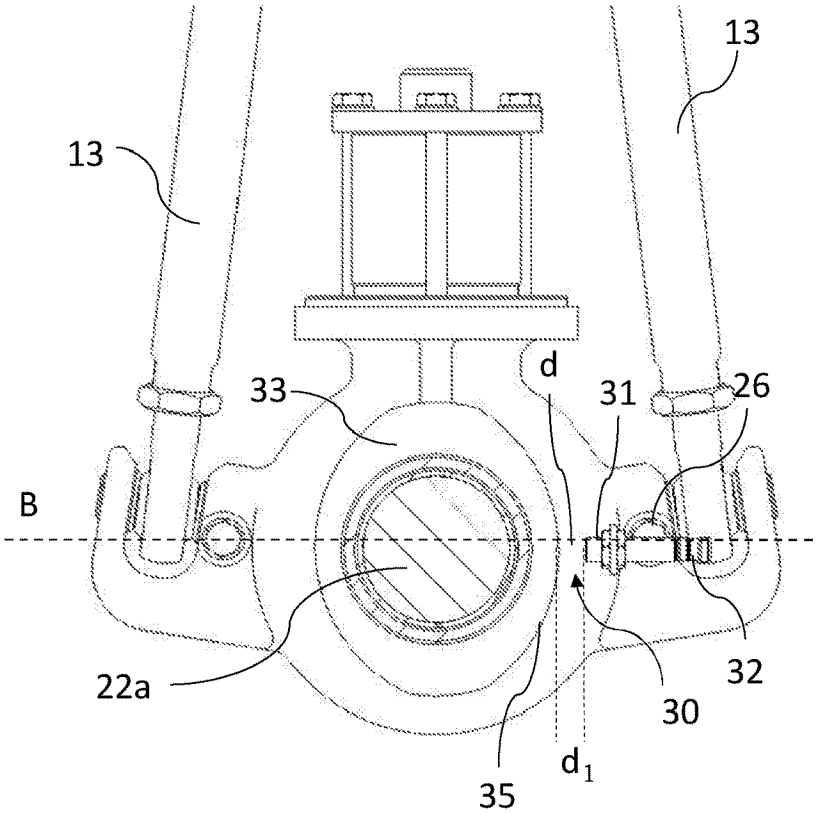
Figure 3A:
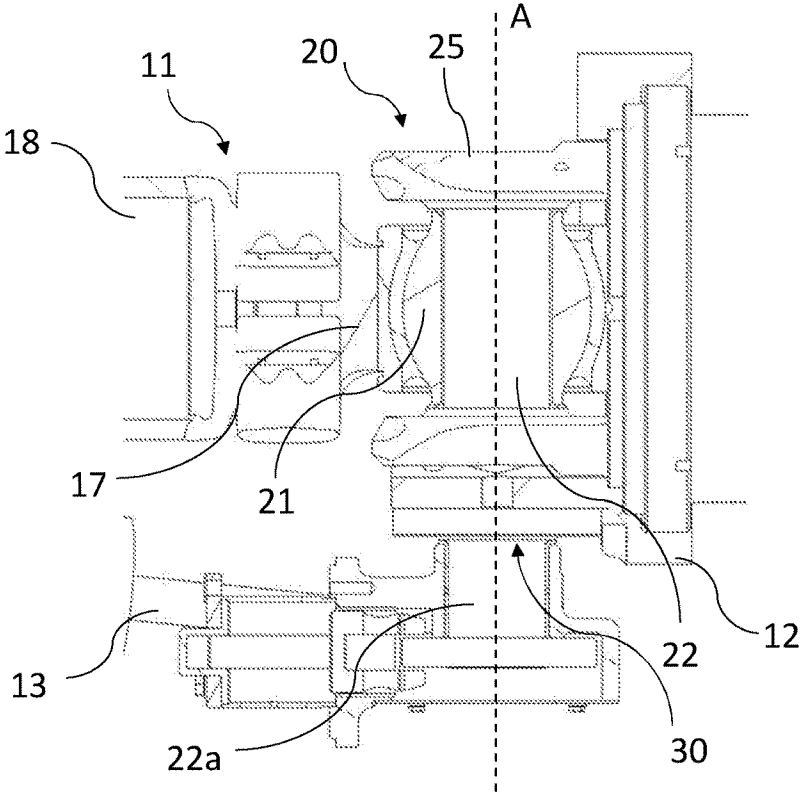
Figure 3D:
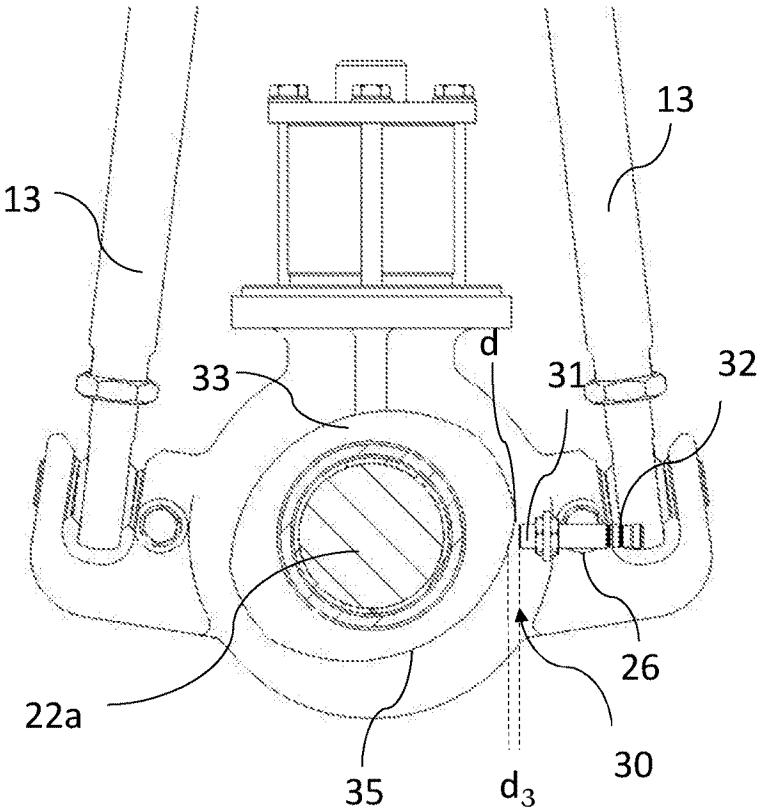
Figure 3C:
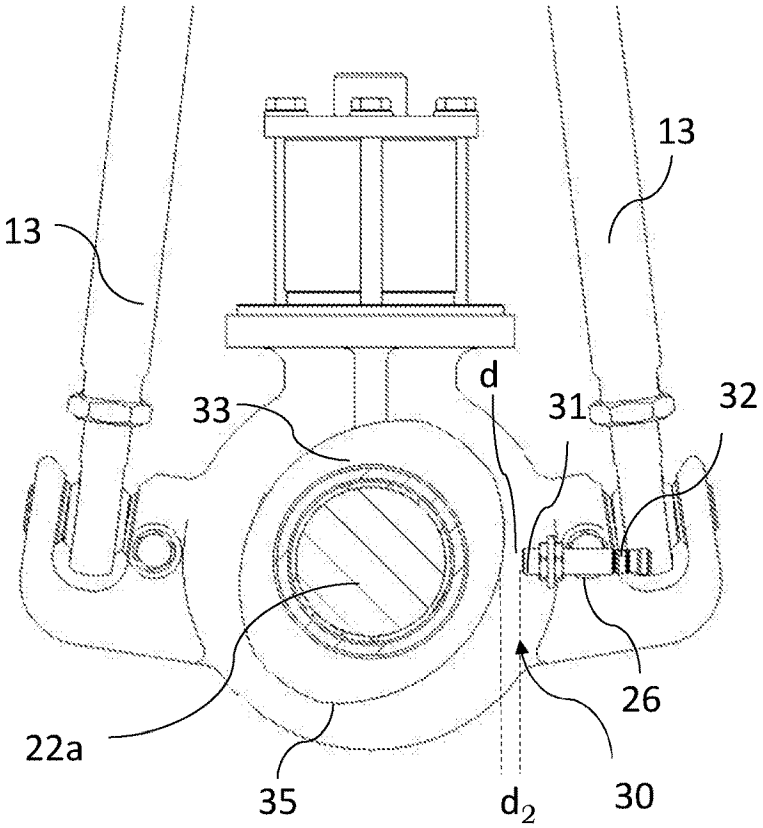
Figure 4B:
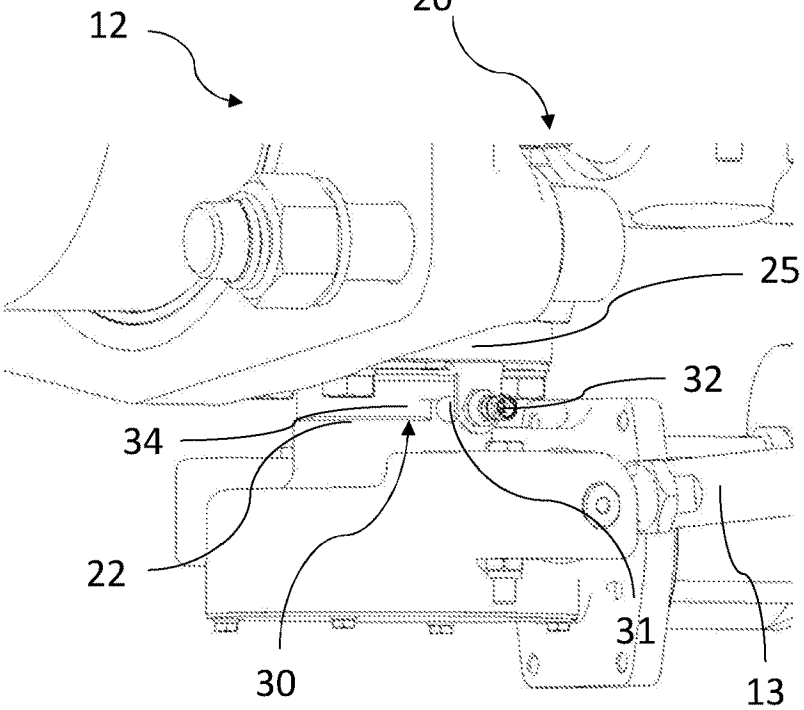
Figure 4A:
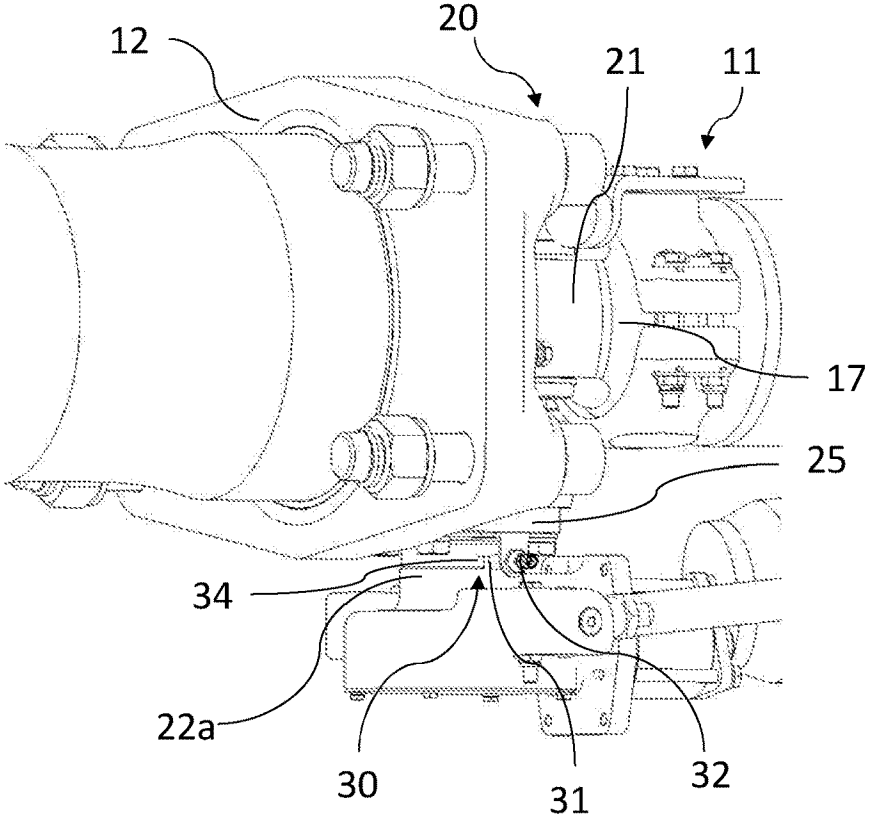

FIG. 3*a* discloses a planar view from the side of a coupler of the first type;

FIG. 3*b* discloses a view from above of a first embodiment of the present invention with a cam disk in a neutral position;

FIG. 3*c* discloses a view from above of the first embodiment of FIG. 3*a* with the cam disk rotated clockwise to a first rotated position;

FIG. 3*d* discloses a view from above of the first embodiment of FIG. 3*a* with the cam disk rotated clockwise to a second rotated position;

FIG. 4*a* discloses a perspective view of a second embodiment of the present invention;

FIG. 4*b* discloses an enlarged perspective view of the second embodiment of FIG. 4*a;*

Figure 5:
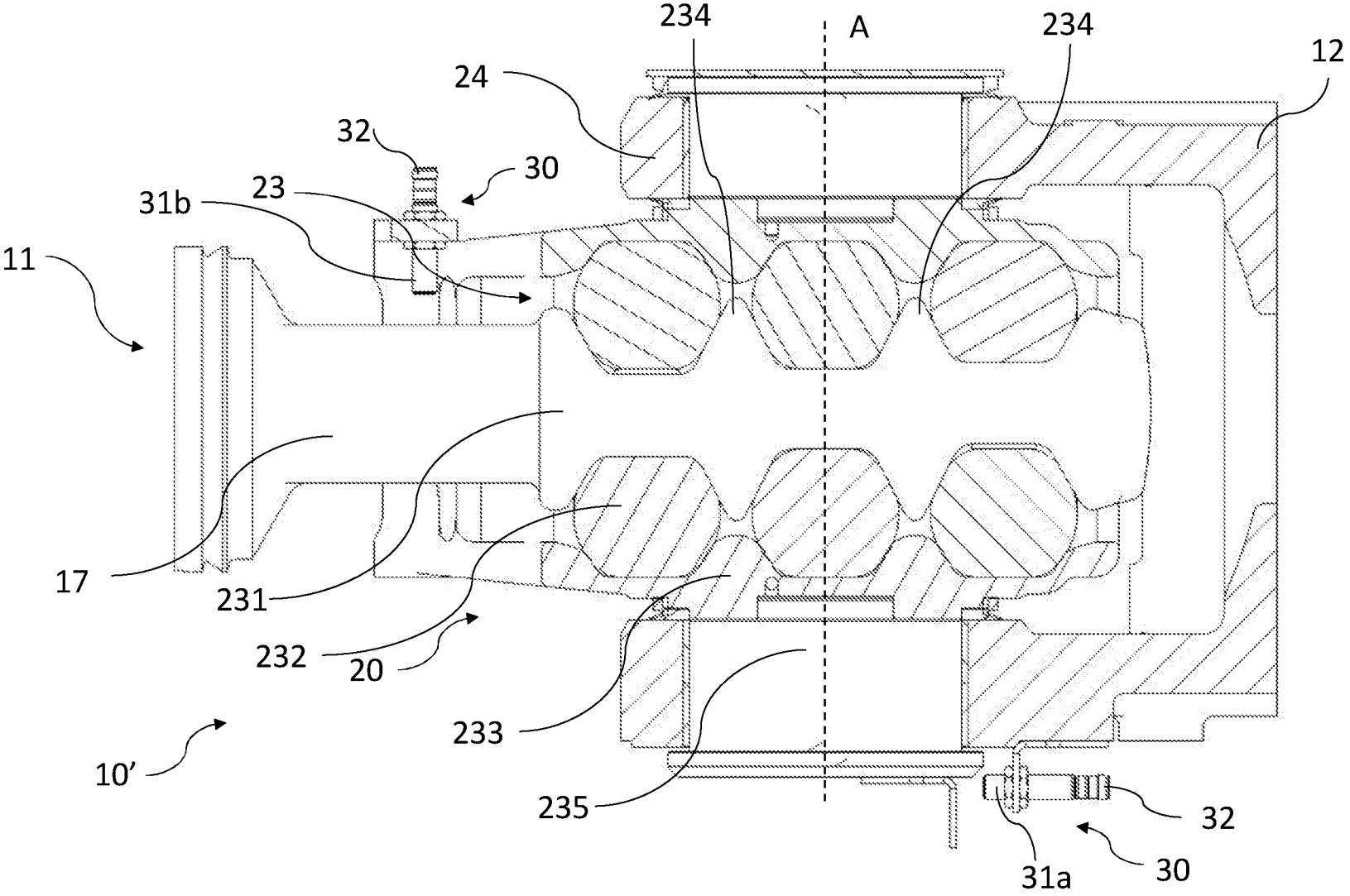
Figure 6C:
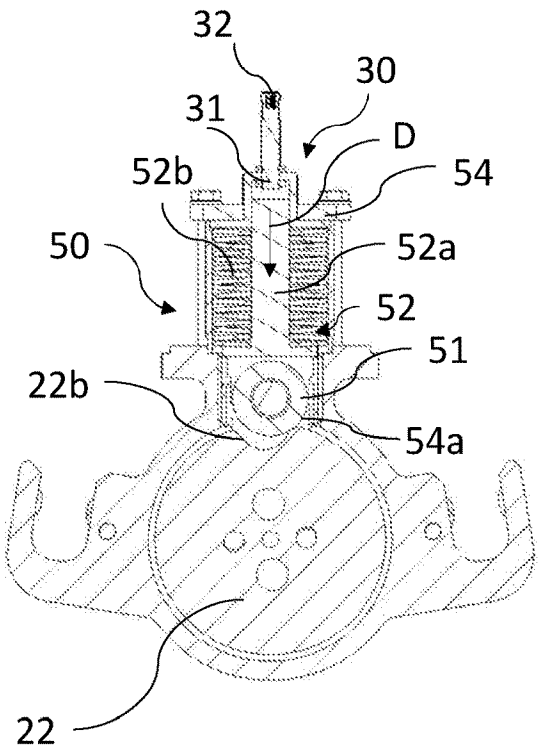
Figure 6B:
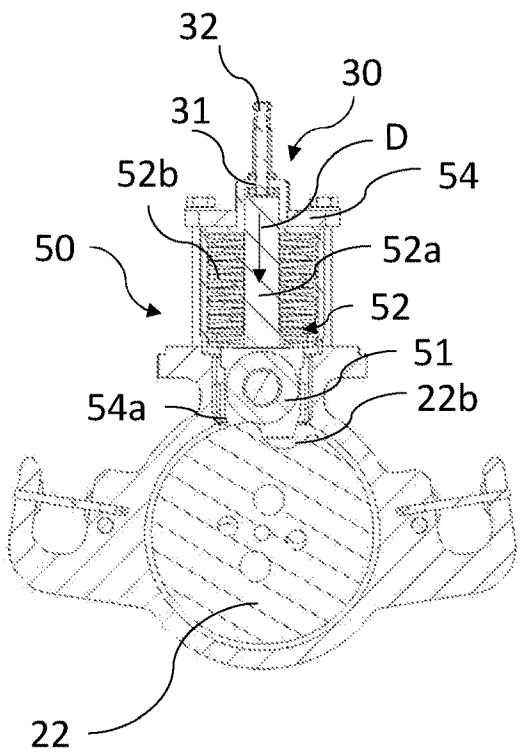
Figure 6A:
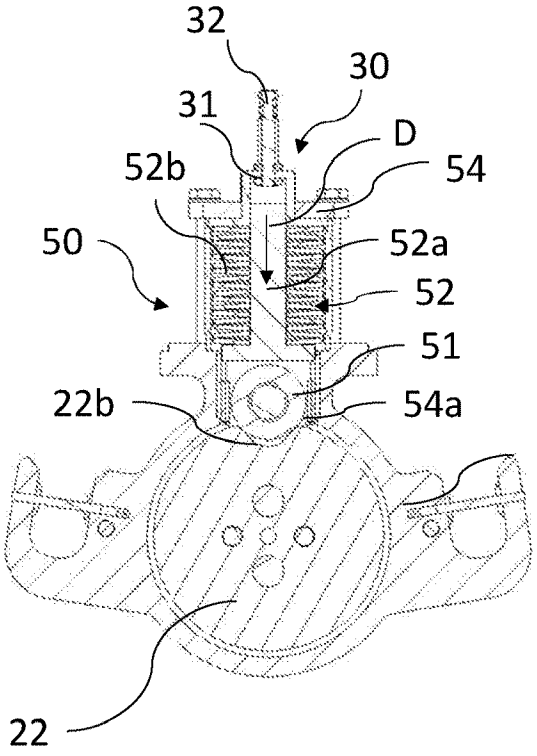
Figure 7:
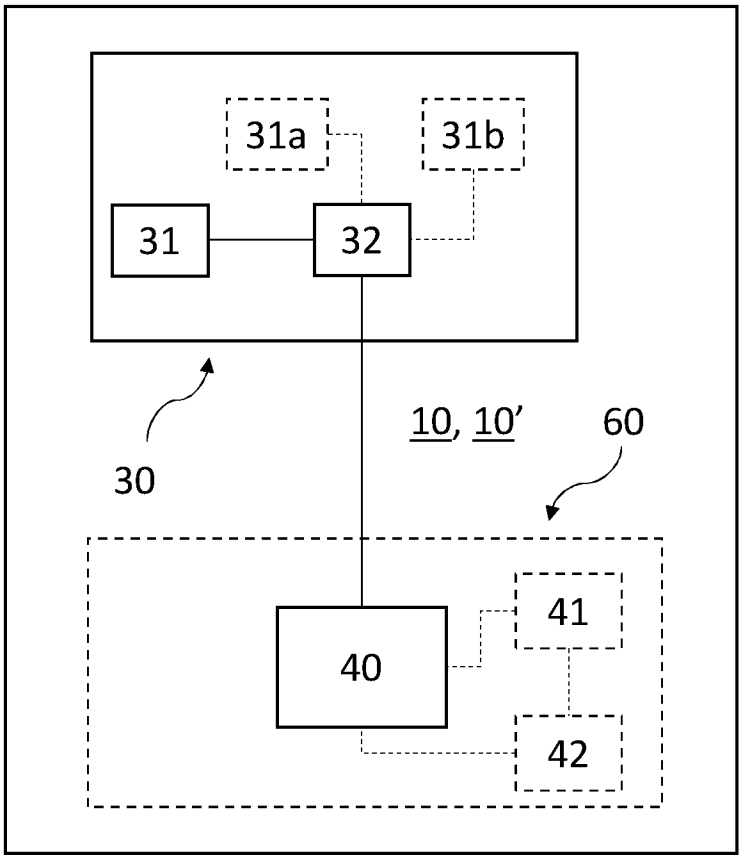
Figure 8:
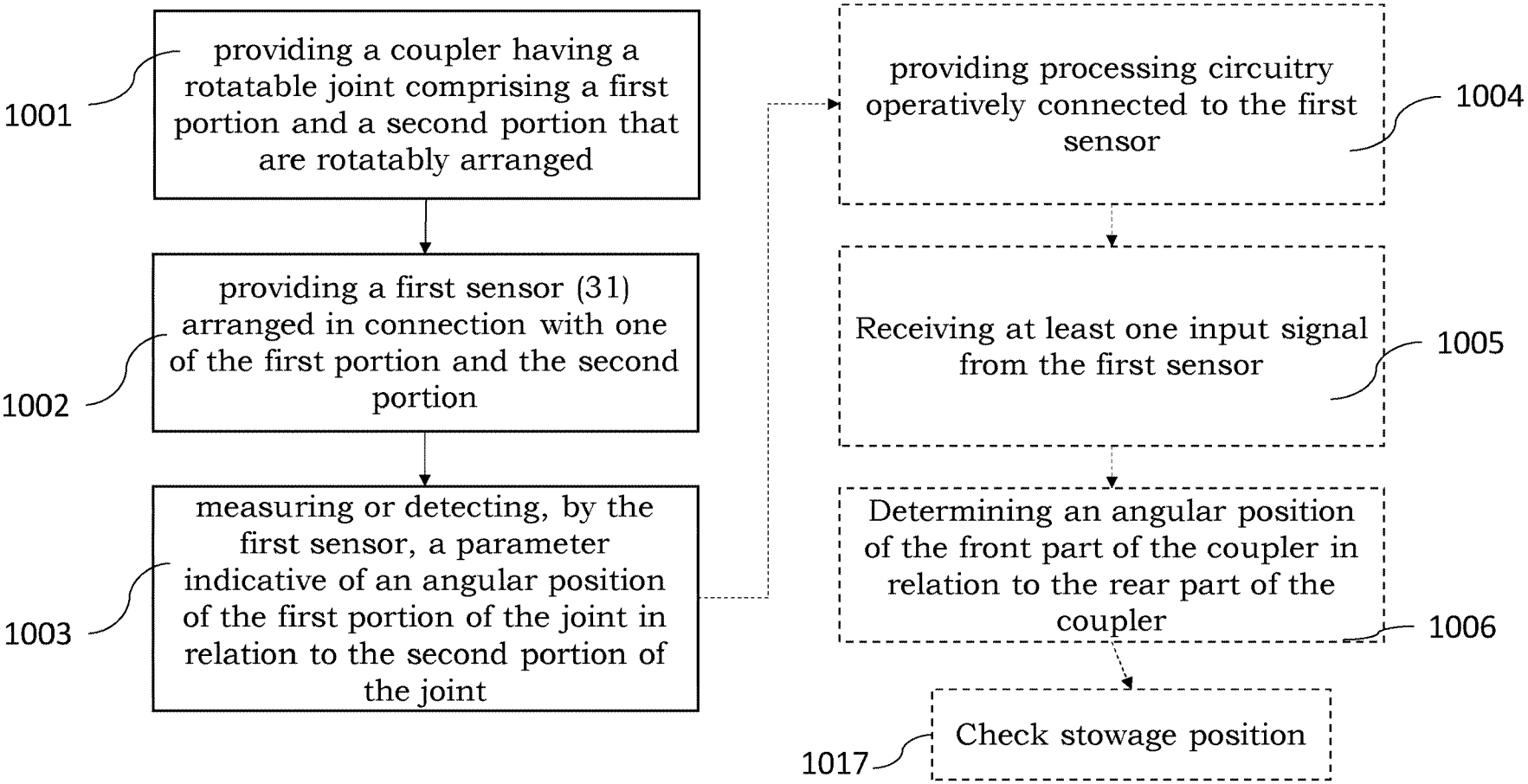
Figure 9:
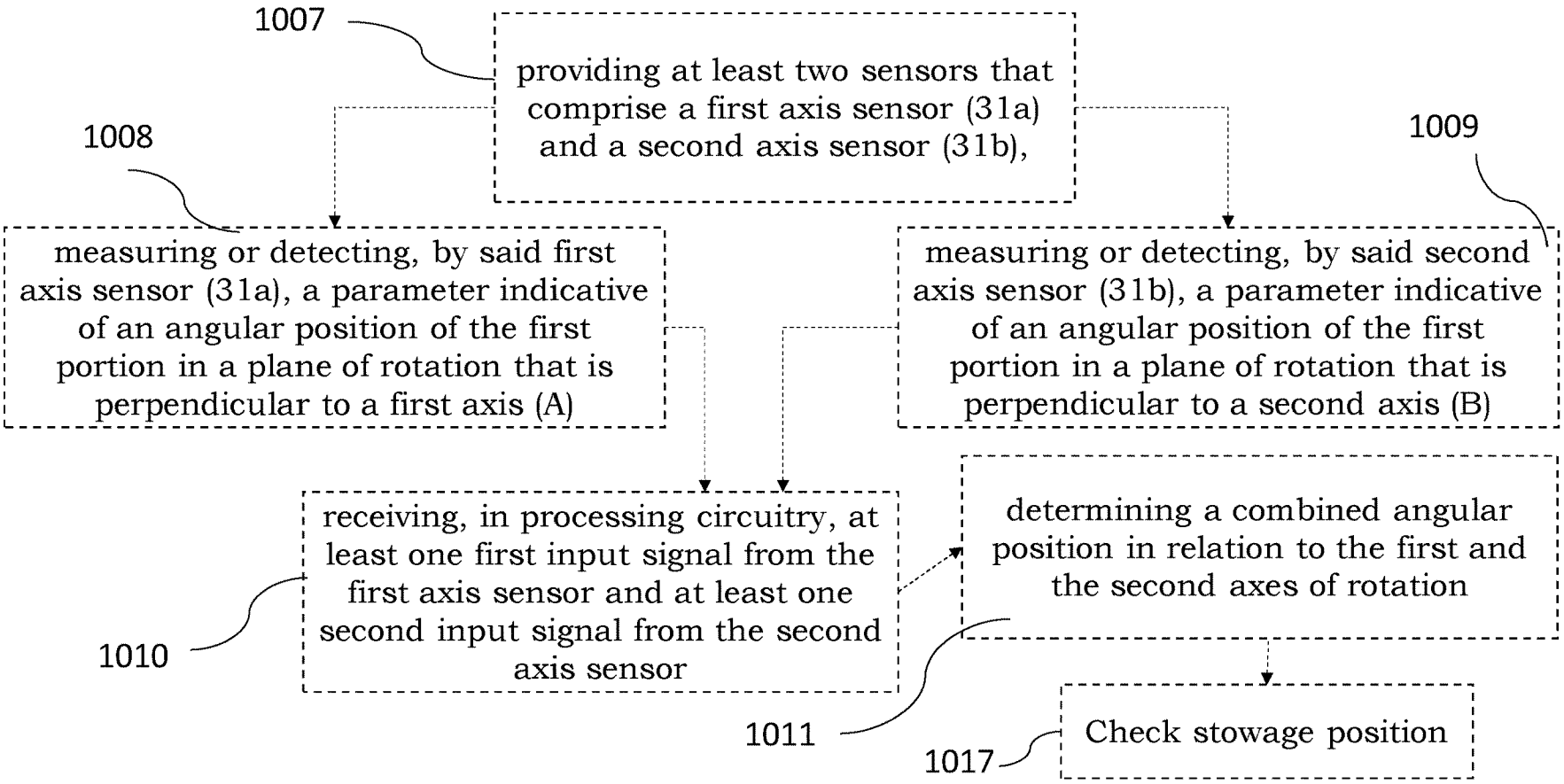
Figure 10:
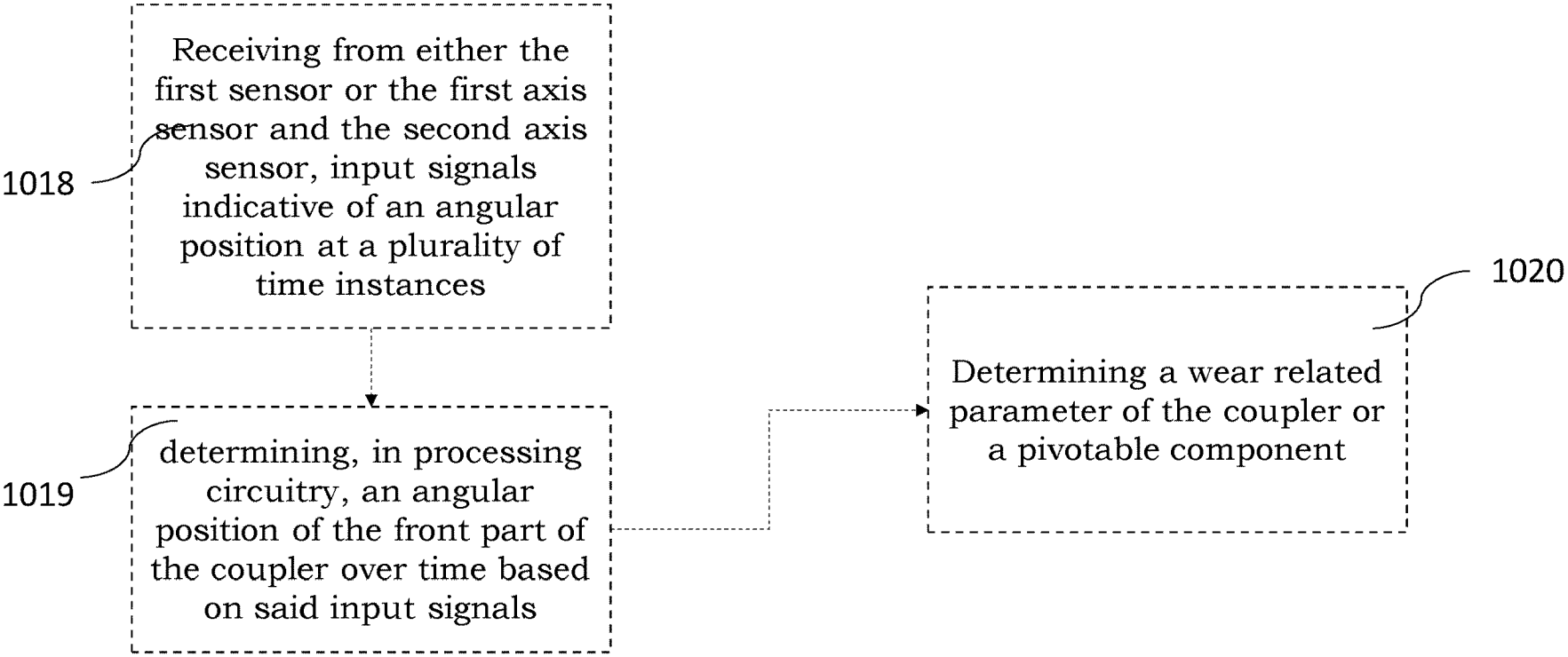
Figure 11:
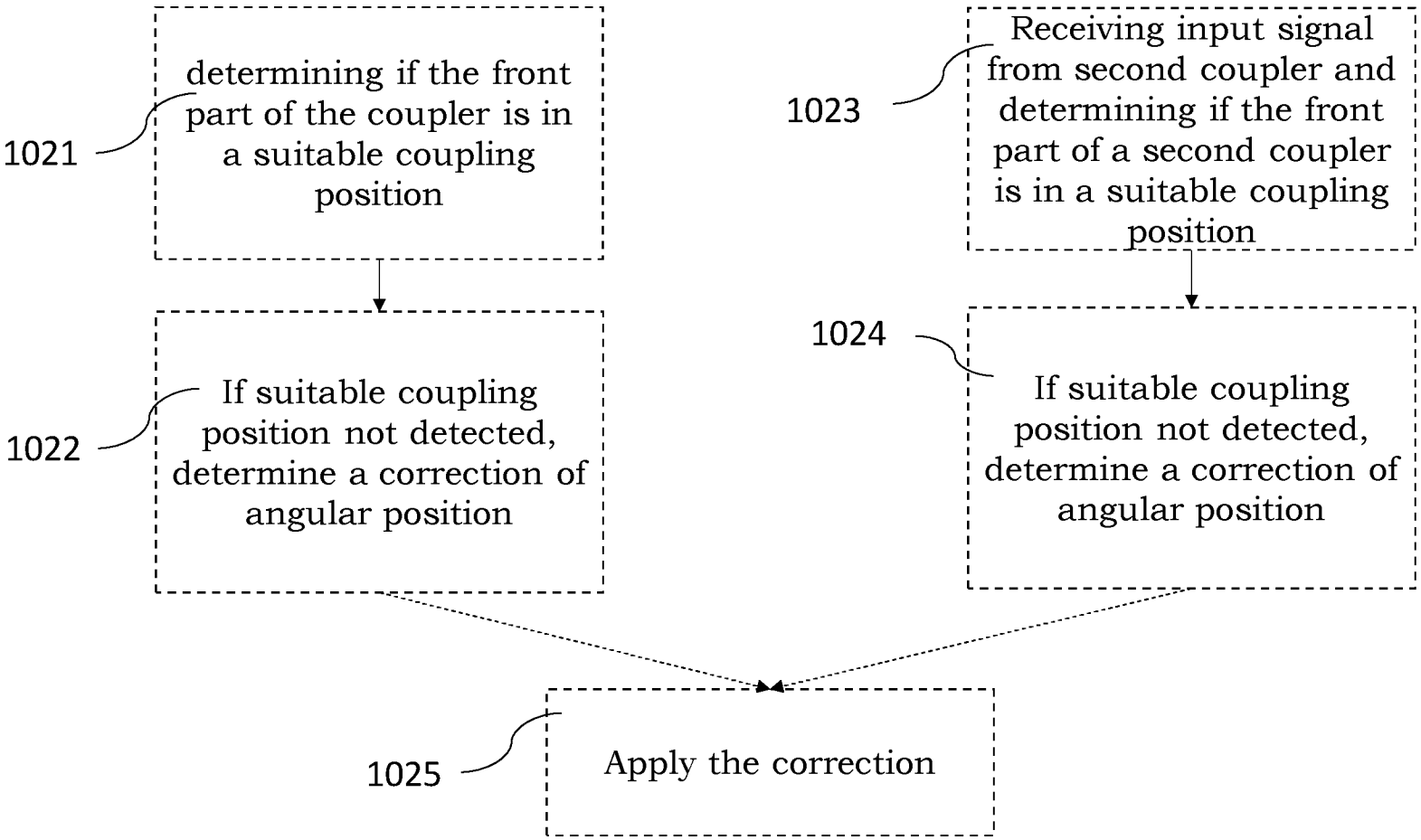
Figure 12:
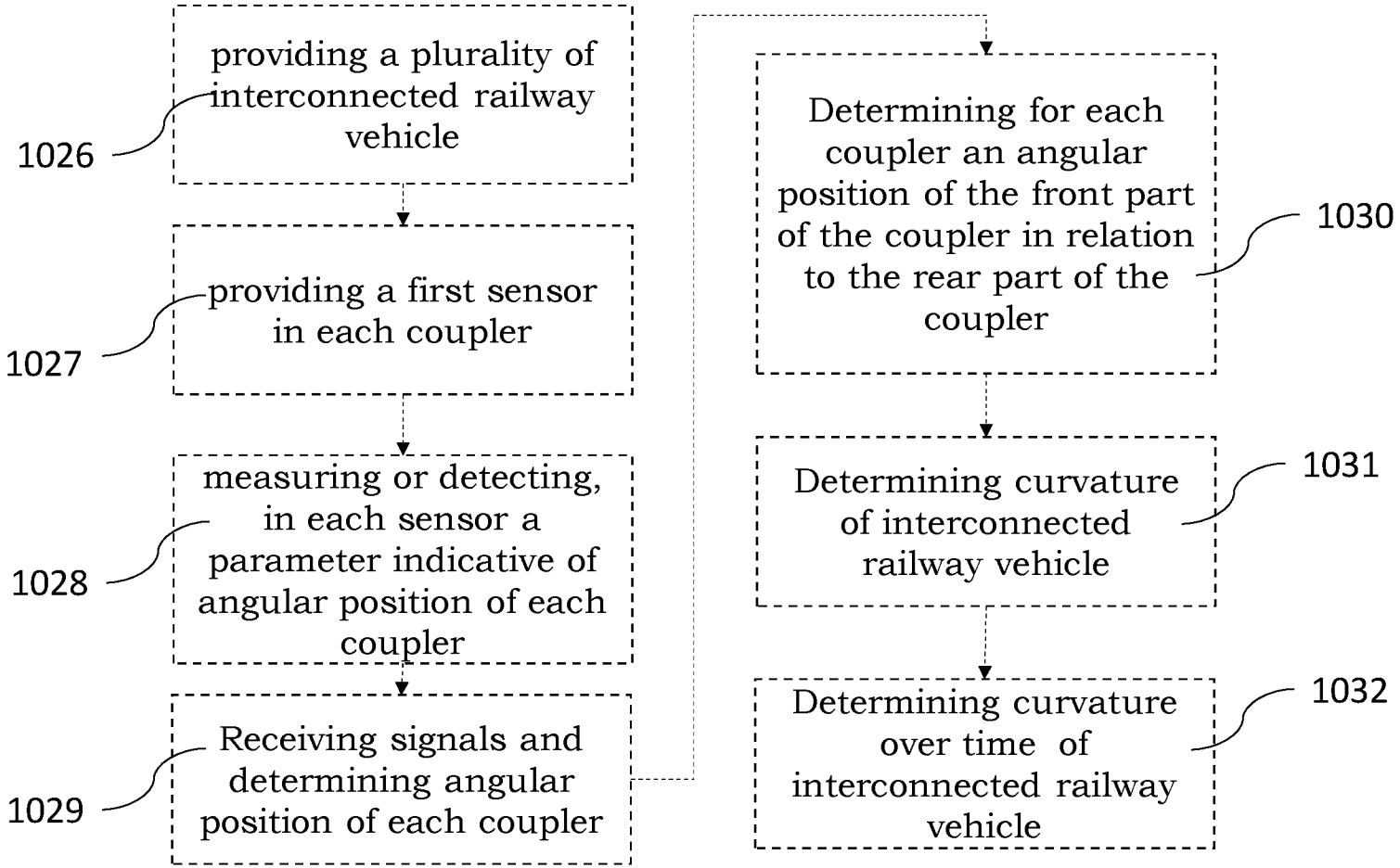
Figure 13B:
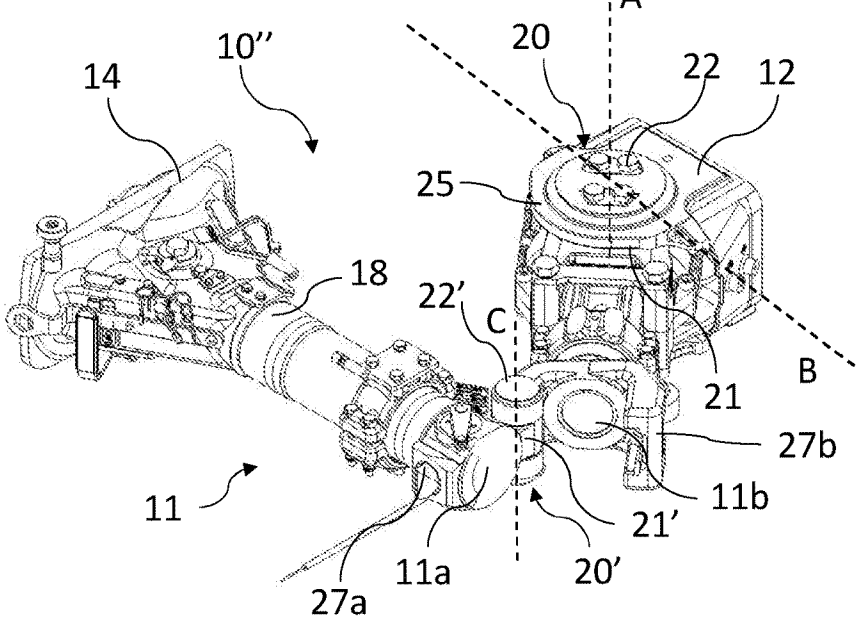
Figure 13A:
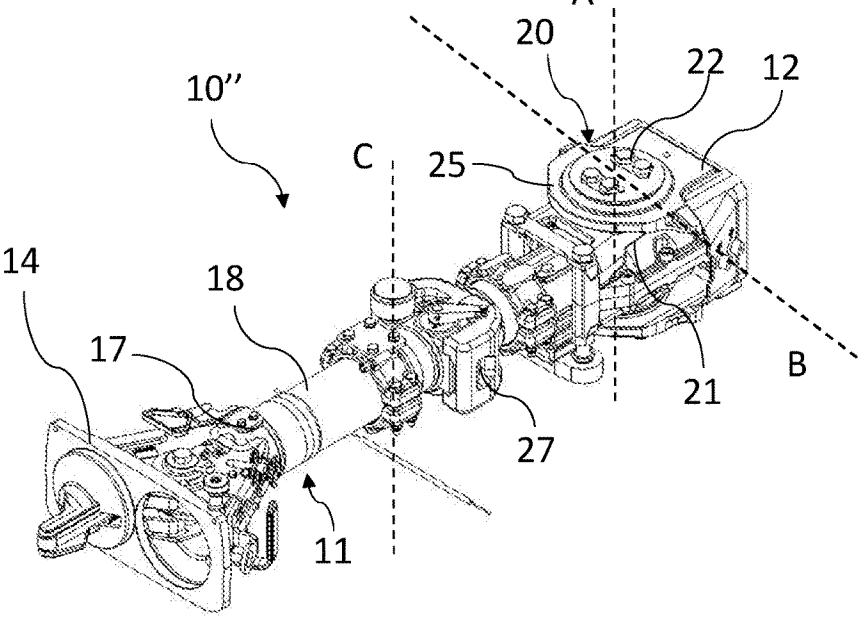

FIG. 5 discloses a cross-sectional view from the side of a third embodiment of the present invention;

FIG. 6*a* discloses a cross-sectional view from above of a fourth embodiment of the present invention in a neutral position;

FIG. 6*b* discloses a cross-sectional view from above of the fourth embodiment with the pivot pin rotated in a clockwise direction;

FIG. 6*c* discloses a cross-sectional view from above of the fourth embodiment with the pivot pin rotated in a counter-clockwise direction;

FIG. 7 discloses an angular position detection system according to an embodiment of the present invention;

FIG. 8 discloses method steps according to an embodiment of the invention;

FIG. 9 discloses method steps according to another embodiment of the invention;

FIG. 10 discloses method steps according to another embodiment of the invention;

FIG. 11 discloses method steps according to another embodiment of the invention;

FIG. 12 discloses method steps according to another embodiment of the invention;

FIG. 13*a* discloses a perspective view of a foldable coupler in a neutral position; and FIG. 13*b* discloses a perspective view of a foldable coupler in a partly folded position.

All the figures are schematic, not necessarily to scale, and generally only show parts which are necessary in order to elucidate the respective embodiments, whereas other parts may be omitted or merely suggested. Any reference number appearing in multiple drawings refers to the same object or feature throughout the drawings, unless otherwise indicated.

DETAILED DESCRIPTION

In the following, various embodiments of the invention will be described with reference to couplers of different design. It is in particular to be noted that the present invention may be used with any kind of coupler that comprises a front part, a rear part and a joint that connects the front part pivotably to the second part. First, two different couplers will be described with reference to FIG. 1*a*-1*b* and FIG. 2*a*-2*b*. The design and function of railway couplers are well-known in the art and will not be described in detail herein, although some of the typical features will be mentioned below.

Then, a foldable coupler will be described with reference to FIG. 13*a*-13*b*. The foldable coupler has the joint connecting the front part pivotably to the second part, and also comprises a midway joint in the front part that allows a first section of the front part to fold in relation to a second section of the front part.

When the wording "connected" or "operatively connected" are used herein, this is to be understood as two parts or components being connected to each other in such a way that they are mechanically connected, optionally via intermediate structures or components, or alternatively it is to be understood as being an electronic connection in such a way that signals may be transmitted from one component to the other in any suitable way.

Each of the embodiments described herein may freely be combined with features from any of the other embodiments, unless it is explicitly stated that such a combination would be unsuitable.

FIG. 1*a*-1*b* disclose a coupler 10 of a first type comprising a front part 11 and a rear part 12. The rear part 12 is configured to be mounted on a railway vehicle as is commonly known in the art. The front part 11 comprises a drawbar 17 and a deformation unit 18, as well as a coupler head 14 with a mechanical coupler for coupling the coupler 10 to a second coupler with a similar design so that the coupler and the second coupler are able to couple to each other. The coupler 10 also comprises a joint 20 having a first portion 21 and a second portion 22 that are rotatably arranged in relation to each other. The first portion 21 is attached to the front part 11 and the second portion 22 is attached to the rear part 12, and in the coupler 10 shown in FIG. 1*a*-1*b* the first portion 21 is in the form of a joint head and the second portion 22 is in the form of a pivot pin on which the joint head is rotatably mounted around a first axis A that is typically vertical when the coupler 10 is in use. The pivot pin 22 is typically held by a holder 25 that is connected to or integrated with the rear part 12. Thus, the joint head 21 and thereby the front part 11 of the coupler 10 may rotate in plane that is perpendicular to the first axis A, i.e. a horizontal plane when the coupler 10 is in use. A second axis B is a transversal axis that extends perpendicularly to a longitudinal direction of the coupler 10 and that is also perpendicular to the first axis A.

In some couplers 10, the pivot pin is instead connected to the front part 11 and the joint head is connected to the rear part. Thus, in the following description of the various embodiments of the present invention, it is to be understood that the configuration of the joint 20 may be either with the joint head as the first portion and the pivot pin as the second portion or with the joint head as the second portion and the pivot pin as the first portion. All embodiments described herein may be realized with both these configurations, requiring only in some instances that the first sensor 31 be moved from a component or structure integrated with or connected to one of the first and second portion to a component or structure integrated or connected to the other. For the present invention, the main purpose is to use the first sensor 31 to detect or measure an angular position of one of the first and second portions in relation to the other.

FIG. 2*a*-2*b* disclose a of coupler 10' of a second type, wherein components that are similar in design and function to the coupler 10 of the first type shown in FIG. 1*a*-1*b* are denoted by the same reference numerals. Thus, the coupler 10' of FIG. 2*a*-2*b* also comprises the rear part 12, the front part 11 with the drawbar 17, the deformation unit 18 and the coupler head 14, and the front part 11 is joined to the rear part 12 by the joint 20. However, the joint 20 is in this type of coupler an elastomer spring joint (EFG) that has a first portion 23 mounted on the front part 11 and a second portion 24 mounted on the rear part 12. The first portion 23 comprises a drawbar end with a plurality of elastomer elements (see FIG. 5 below) configured so that the drawbar may pivot in a vertical direction and also with a pivot connection 235 configured so that the drawbar may pivot in the horizontal direction, and the second portion 24 comprises a holder that holds a gimbal in which the drawbar end with the elastomer elements is pivotably arranged. Due to the configuration of the elastomer spring joint, and end 231 of the first portion 23 is able to pivot both in a plane that is perpendicular to the first axis A and a plane that is perpendicular to the second axis B.

FIG. 13*a*-13*b* disclose a foldable coupler 10", wherein components that are similar in design and function to the coupler 10 of the first type shown in FIG. 1*a*-1*b* and/or the coupler 10' of the second type shown in FIG. 2*a*-2*b* are denoted by the same reference numerals. Thus, the foldable coupler 10" of FIG. 13*a*-13*b* also comprises the rear part 12, the front part 11 with the drawbar 17, the deformation unit 18 and the coupler head 14, and the front part 11 is joined to the rear part 12 by the joint 20. However, in the foldable coupler 10" the front part 11 is formed by a first section 11*a* of the front part 11 comprising the coupler head 14 and a second section 11*b* of the front part 11 that comprises the first portion 21 of the joint 20. The first section 11*a* and the second section 11*b* are joined in a midway joint 20' by a first midway joint portion 21' being comprised in the first section 11*a* and a second midway joint portion 22' being comprised in the second section 11*b*. The midway joint 20' is formed by the first midway joint portion 21' being pivotably arranged on the second midway joint portion 22'.

The foldable coupler 10" is shown in FIG. 13*a*-13*b* with the joint 20 that is similar or identical to the joint 20 of the coupler 10 of the first type, but it is to be noted that the foldable coupler 10" could instead comprise the elastomer spring joint (EFG) of the coupler 10' of the second type. Operation of the foldable coupler 10" is similar or identical to the coupler 10 of the first type or the coupler 10' of the second type, but also includes the additional function of using the midway joint 20' to fold the coupler to a stowing position suitable for when the coupler is uncoupled. The foldable coupler 10" therefore includes a release mechanism 27 that suitable comprises a first interconnecting part 27*a* on the first section 11*a* and a second interconnecting part 27*b* on the second section 11*b*. Such release mechanisms 27 are well-known in the art and may be varied in design and operation. Upon release of the release mechanism 27, the first section 11*a* is pivotable in relation to the second section 11*b* to a stowage position. FIG. 13*a* shows the neutral position with the release mechanism holding the first section 11*a* fixed in relation to the second section 11*b*, whereas FIG. 13*b* shows a partly folded position where the release mechanism has been activated and the first section 11*a* is pivoted about a third axis C in relation to the second section 11*b*. The front part 11 is also pivoted in relation to the rear part 12 about the first axis A. Upon further rotation in both joints 20, 20' the foldable coupler 10" reaches the stowage position (not shown). The third axis C may in some embodiments be parallel to the first axis A, but may in other embodiments be non-parallel to the first axis A.

As used herein, the term "angular position" is to be understood as including either an angular position as such or a displacement from a neutral position, in at least one plane or direction or rotation. Thus, in some embodiments the angular position may be an angular position in one plane and in other embodiments the angular position may be a combined angular position in two planes or in three dimensions. In yet other embodiments, the angular position may instead be an angular displacement from a neutral position but without indicating in which rotational direction the angular displacement takes place.

The present invention will now be described in more detail with reference to FIG. 3*a* onwards, disclosing an angular position detection assembly in connection with both the coupler of the first type shown in FIG. 1*a*-1*b* and the coupler of the second type shown in FIG. 2*a*-2*b*, as well as in connection with the foldable coupler of FIG. 13*a*-13*b* and with other types of couplers.

In its most general form, most embodiments of the present invention comprise an angular position detection assembly 30 that is configured to measure or detect a parameter indicative of an angular position of the front part 11 of the coupler 10, 10', 10" in relation to the rear part 12. The angular position detection assembly 30 comprises a first sensor 31 along with a transmitter 32 that is operatively connected to the first sensor 31 so that a signal from the first sensor 31 can be transmitted by the transmitter 32. In some embodiments of the invention, the angular position detection assembly is combined with processing circuitry and optionally additional components such that signals from the first sensor 31 can be used for determining the angular position of the front part 11 of the coupler 10, 10', 10" in relation to the rear part 12, and in some embodiments signals from a plurality of angular position detection assemblies may be combined by processing circuitry so that orientation of couplers connected to a plurality of rail vehicles that together form a train may be determined. There are also embodiments of the invention that, instead of comprising the coupler together with the first sensor 31, comprise a centering device together with the angular position detection assembly 30. Such a centering device is suitable for use with centering the front part 11 in relation to the rear part 12. When it is stated herein that a component such as the first sensor 31 of the angular position detection assembly 30 is mounted or arranged in connection with the second portion 22, 24 of the joint 20, this is to be understood as the component being mounted on any component or structure of the coupler 10, 10', 10" that is non-pivotably connected to the second portion 22, 24. This includes the rear end 12 of the coupler that is non-pivotably connected to the second portion 22, 24 but excludes the front part 11 since the connection of the front part 11 to the second portion 22, 24 of the joint 20 is a pivotable connection via the first portion 21, 23 of the joint. Similarly, where it is stated that a component such as the first sensor 31 is mounted or arranged in a connection with the first portion 21, 23 of the joint, this is to be understood as the component being mounted on any component or structure of the coupler 10, 10', 10" that is non-pivotably connected to the first portion 21, 23.

Also, it is in particular to be noted that when it is stated below that the first sensor 31 is arranged in connection with the second portion 22, 24 and configured to measure or detect a parameter that is indicative of an angular position of the first portion 21, 23, this is to be understood as including embodiments where the first sensor 31 is instead arranged in connection with the first portion 21, 23 and configured to measure or detect a parameter that is indicative of an angular position of the second portion 22, 24.

In embodiments including the foldable coupler 10", an angular position detection assembly 30 according to the invention may also be configured to measure or detect a parameter indicative of an angular position of the first section 11*a* of the front part 11 in relation to the second section 11*b* of the front part 11. In such embodiments, the first sensor 31 is arranged in connection with one of the first midway joint portion 21' and the second midway joint portion 22', and the first sensor 31 is configured to measure or detect a parameter that is indicative of an angular position of the other of the first midway joint portion 21' and the second midway joint portion 22'. When the invention is described herein, it is to be noted that any embodiments disclosing detecting or measuring an angular position of the first portion 21, 23 of the joint 20 in relation to the second portion 22, 24 of the joint 20 may equally be applied to measuring or detecting an angular position of one of the first midway joint portion 21' and the second midway joint portion 22' to the other. When a first sensor 31 is provided to measure or detect a parameter in connection with the midway joint, the first sensor 31 may be referred to as a first midway joint sensor. It is to be noted, however, that properties and operation of the first midway joint sensor may be identical to the first sensor 31 as described throughout the present application. Each of these embodiments of the invention will now be described.

In FIG. 3*a*, the joint 20 of the coupler 10 of the first type is shown in more detail, with the pivot pin 22 mounted in the holder 25 of the rear part 12 and the joint head 21 arranged around the pivot pin 22. Thereby, the joint head 21 and the pivot pin 22 are rotatably connecting the front part 11 to the rear part 12 of the coupler 10. The pivot pin 22 suitably has a lower part 22*a*, or a connected component extending downwards, on which additional components such as support dampers 13 may be mounted. In a first embodiment of the invention, the angular position detection assembly 30 is also mounted in connection with the lower part 22*a* or connected component of the pivot pin 22 and this is advantageous since it both allows for mounting the angular position detection assembly 30 in a convenient way without affecting operation of the coupler while at the same time being able to perform accurate measurements.

FIG. 3*b* discloses the lower part 22*a* of the pivot pin 22 from above with the pivot pin 22 itself hatched. The angular position detection assembly 30 in the first embodiment comprises a first sensor 31 that is operatively connected to a transmitter 32 in such a way that signals from the first sensor 31 may be transmitted by the transmitter. In some embodiment, the first sensor 31 is combined with an additional sensor for more accurately measuring or detecting the parameter, and in some embodiments a second sensor is also provided to measure or detect another parameter. If more than one sensor 31 is used, each sensor 31 may be connected to or integrated with a transmitter 32, or alternatively the sensors 31 may each be connected to one transmitter 32 that is configured to transmit signals from all the sensors 31 consecutively or simultaneously. The angular position detection assembly 30 also comprises a cam disk 33 that is mounted on the pivot pin 22 so that a rotation of the pivot pin 22 also causes a corresponding rotation of the cam disk 33. This may be achieved e.g. by fixing the cam disk 33 to the pivot pin 22 by welding, bolting or screwing, or in any other way that enables a secure attachment of the cam disk 33 to the pivot pin 22. The cam disk 33 in the first embodiment has an elongated or oval shape so that its outer edge 35 is curved, and the first sensor 31 is mounted adjacent to the cam disk 33 on any structure that is non-pivotably attached to the joint head 21. As shown in FIG. 3*b*, the first sensor 31 is fastened to a lower part 26 of the front part 11 that is connected to the joint head 21 through a non-pivotable connection. By arranging the first sensor 31 on a structure that is non-pivotably connected to the first portion 21 of the joint and arranging the cam disk in a non-pivotable connection to the second portion 22 of the joint 20, the angular position of the first portion 21 in relation to the second portion 22, or vice versa, can be determined.

In the embodiment shown in FIG. 3*a*-3*d*, when it is stated that the pivot pin 22 and the cam disk 33 are rotating, this is to be understood as a relative rotation of the pivot pin 22 and the cam disk 33 in relation to the first portion 21 of the joint 20. Thus, the rotation may also be understood as the joint head 21 and other components connected to the joint head 21 of the first portion 21 of the joint rotating in relation to the pivot pin 22 and cam disk 33 of the second portion 22 of the joint 20.

The first sensor 31 is suitably a distance sensor that is configured to measure or detect a distance to another object but may alternatively be another kind of sensor such as an optical sensor. The cam disk 33 is suitably arranged to protrude in a radial direction from the pivot pin 22, said radial direction being a direction that is perpendicular to the first axis A, i.e. to an axial direction of the pivot pin 22. When the cam disk 33 rotates together with the pivot pin 22, the closest distance in the radial direction between the first sensor 31 and the curved surface that forms the edge 35 of the cam disk 33 varies as described herein. Thus, when a rotation of the pivot pin 22 is mentioned herein it is to be understood as a relative rotation of the pivot pin 22 and the joint head 21 in relation to each other.

The first sensor 31 is thus arranged adjacent to the cam disk 33 and configured to measure a distance d from the first sensor 31 to the cam disk 33. FIG. 3*b* shows the pivot pin 22 in a neutral position with the front part 11 rear part 12 so that the front part 11 does not deviate from a position perpendicular to the second axis B. In this position, a point on the curved edge 35 of the cam disk 33 that is directly opposite the first sensor 31 is at a first distance $d_1$.

FIG. 3*c* discloses the cam disk 33 rotated to a first position in a clockwise direction. The distance d from the edge 35 of the cam disk 33 to the first sensor 31 is now a second distance $d_2$ that is smaller than the first distance $d_1$ due to the shape of the cam disk 33. FIG. 3*d* discloses the cam disk 33 rotated further in the clockwise direction to arrive at a second position, in which the distance from the edge 35 of the cam disk 33 to the first sensor 31 is a third distance $d_3$ that is even smaller than the second distance $d_2$. Thus, by the first sensor 31 measuring the distance d that varies as the pivot pin 21 rotates, the angular position of the pivot pin 22 in relation to the joint head 21, and thereby also the angular position of the front part 11 that is connected to the joint head 21 in relation to the rear part 12 that is connected to the pivot pin 22 may be determined.

In the first embodiment as shown in FIG. 3*a*-3*d*, the cam disk 33 is oval in shape and is mounted so that the distance d is greatest in the neutral position and decreases as the angular displacement increases. It is however to be noted that both the shape of the cam disk 33 with the edge 35 and its orientation in relation to the first sensor 31 may differ so that the distance d could be smallest in the neutral position or so that the smallest distance d could occur somewhere between the neutral position and a position that corresponds to a maximum rotation of the pivot pin 22.

In some embodiments, at least one additional first sensor 31' may be mounted in connection with the cam disk 33, suitably at a distance from the first sensor 31 as shown in FIG. 3*b*-3*d* so that the closest points on the edge 35 of the cam disk 33 to each of the first sensor 31 and additional sensor(s) 31' differs. In this way, an increased accuracy may be achieved when measuring the angular displacement of the cam disk 33.

The first sensor 31 of the first embodiment thus serves to measure the distance to the cam disk 33, and to send signals representing these measurements to the transmitter 32 that in turn is configured to transmit the signals to processing circuitry 40 (see FIG. 7 below) that may be provided in connection with the coupler 10, 10', 10", in connection with a railway vehicle on which the coupler 10, 10', 10" is mounted or connected, or at a remote site. Processing circuitry 40 that receives the measurements from the first sensor 31 is then configured to determine the angular displacement of the front part 11 of the coupler 10, 10', 10" by determining the angular displacement of the cam disk 33 that corresponds to the measured distance d.

FIG. 4*a*-4*b* disclose a perspective view and an enlarged perspective view of a second embodiment that is similar to the first embodiment of FIG. 3*a*-3*d*. The angular position detection assembly 30 of the second embodiment that comprises the first sensor 31 and the transmitter 32 is mounted on a structure connected to the holder 25, i.e. also connected to the pivot pin 22. However, instead of the cam disk 33 of the first embodiment, the second embodiment comprises a marking surface 34 that is provided in connection with the joint head 21, i.e. on a part of the coupler 10 that is non-pivotably connected to the joint head 21. One advantageous embodiment comprises the marking surface 34 on a centering house of the coupler 10. The first sensor 31 is suitably an optical sensor that is configured to detect at least one marker on the marking surface 34, so that any marker that faces the first sensor 31 is detected. As the joint head 21 rotates, the marker may be available or unavailable for the first sensor 31 so that it is detected only when in a suitable position that faces the first sensor 31. Alternatively, a plurality of markers on the marking surface 34 may be provided and by rotating one of the joint head 21 and the pivot pin 22 in relation to the other, the first sensor 31 is able to detect any of the markers that faces the first sensor 31. This embodiment is particularly advantageous since a large range of angular position may be detected using only one first sensor 31. However, if desired at least one additional sensor 31' may also be provided in order to further increase accuracy. The sensors 31, 31' may then be arranged at a distance from each other, such as on different sides of the pivot pin 22 or at least at a distance in the circumferential direction in relation to the pivot pin 22. At least one signal that corresponds to the detected marker(s) or that signifies that no marker is detected may then be transmitted by the transmitter 32 to which the first sensor 31 and optionally additional sensor 31' is operatively connected. Processing circuitry 40 that receives the signal may then be configured to determine the angular position of the joint head 21 in relation to the pivot pin 22 based on the signal, as will also be described in more detail below.

FIG. 5 discloses a third embodiment of the angular position detection assembly 30 mounted on a coupler 10' of the second type having an elastomer spring joint (EFG) 20 that allows the front part 11 to pivot around both the first axis A and the second axis B that is perpendicular to a longitudinal direction along the coupler 10'. The first portion 23 of the joint 20 comprises an end 231 of the drawbar 17 of the front part 11, and from the end 231*a* plurality of projections 234 protrude. The projections 234 in turn are anchored in a plurality of elastomeric, resiliently deformable rings 232 that surround the end 231 and is in turn encased by an elastomeric sleeve 233 of the gimbal. The elastomeric sleeve 233 is held by a pivot connection 235 that is able to pivot in relation to the second portion 24.

The angular position detection assembly 30 comprises the first sensor 31 that in this embodiment is a first axis sensor 31*a* that is connected to the second portion 24 and that is configured to measure or detect a parameter indicative of an angular position in relation to the first axis A so that a horizontal angular position of the first portion 23 can be determined. Suitably, the angular position detection assembly also comprises at least one second axis sensor 31*b* that is fixedly connected to the second portion 24 and that is configured to measure or detect a parameter indicative of an angular position about the second axis B so that a vertical angular position of the first portion 23 with the end 231 of the drawbar 17 can be determined. In this third embodiment, each of the first and second sensors 31*a*, 31*b* may be optical sensors that are configured to detect at least one marker on marking surfaces arranged opposite, as already disclosed in the second embodiment above. Alternatively, the first and second sensors 31*a*, 31*b* may be sensors configured to detect a distance from a curved edge arranged opposite as in the first embodiment described above. Alternatively, other kinds of sensors may be used as understood by the skilled person as long as they are able to detect an angular position of a surface, structure, or marker opposite. It is particularly advantageous to be able to detect the angular position of the first portion 23 in relation to both a horizontal displacement and a vertical displacement, since this allows for processing circuitry that receives signals from the first and second axis sensors 31*a*, 31*b* to determine a combined position that accurately describes the position of the front part 11 in relation to the rear part 12.

FIG. 6*a* discloses a fourth embodiment where the first sensor 31 for detecting or measuring the angular position is arranged in connection with a centering device 50. The fourth embodiment may comprise the centering device 50 with the angular position detection assembly 30, but may alternatively comprise the centering device 50, the angular position detection assembly 30 and the coupler 10 having the pivot pin 22 that is configured to be used with at least one centering device 50. Thus, in the following the centering device 50 is described in connection with the pivot pin 22 of the coupler 10, but it is to be noted that the present invention may refer to the centering device 50 as such without also including the coupler 10 with the pivot pin 22. In such cases, the centering device 50 according to the present invention may be mounted on any type of coupler that comprises a pivot pin or other pin or rotary shaft that is suitable for use with a conventional centering device 50.

It is particularly to be noted that the embodiments that include the centering device 50 may include the first sensor 31 but not include the transmitter 32.

In embodiments without the transmitter, the first sensor 31 may instead comprise or be connected to a memory unit for storing information from the first sensor 31 so that an operator may extract this information during maintenance or similar situations where the coupler 10 is not in use. This allows for determining angular positions over time so that wear etc. may be determined.

Thus, the centering device 50 comprises a housing 54 in which a contact element 51 is arranged. The contact element 51 is biased in a first direction D towards an opening 54*a* by a biasing device 52 provided in the housing 54. In the fourth embodiment of FIG. 6*a*-6*c* the biasing device 52 comprises a piston 52*a* that presses against the contact element 51 and that in turn is biased by at least one spring 52*b* that provides the biasing force. In other embodiments, the biasing device 52 can instead comprise a piston that is biased by hydraulic or pneumatic means such as a pressure chamber in which the piston is at least partially held and that provides a biasing force in the first direction D. Alternatively, any other suitable kinds of biasing devices 52 may be used as long as a biasing force against the contact element 51 is provided.

The contact element 51 is suitably in the form of a roll that is able to rotate about an axis that is perpendicular to the first direction D and that is also able to move linearly in the first direction. When the centering device 50 is arranged in a coupler 10, the first direction D is a radial direction towards a center of the pivot pin 21.

Also provided in the centering device 50 is the first sensor 31 that is configured to measure or detect a parameter that is indicative of a position of the contact element 51. The transmitter 32 may optionally also be provided and be configured to receive at least one signal from the first sensor 31 and transmit it to processing circuitry 40.

The parameter measured by the first sensor 31 may be a parameter that is indicative of the position of the piston 52*a*. In the fourth embodiment shown by FIG. 6*a*-6*c* this parameter is a position of the piston 52*a* of the biasing device 52. Alternatively, the parameter may be an internal pressure in a chamber of the piston or of a housing in which the piston is arranged. Alternatively, the parameter may be at least one property of the spring 52*b* such as a compression or extension of the spring 52*b* that in turn indicates the position of the piston 52*a* on which the spring 52*b* acts. As another alternative, the parameter may be a rotation of contact element 51 that gives information about how far along the recess the contact element 51 has rolled as the pivot pin 22 rotates in relation to the centering device 50. And alternatively, other parameters may be measured or detected as long as they in some way indicate the position of the contact element 51.

When the centering device 50 is arranged in connection with the pivot pin 22 of the joint 20 of the coupler 10, the pivot pin 22 itself is adapted to the centering device 50 by comprising at least one recess 22*b* into which the contact element 51 protrudes. In FIG. 6*a*, the pivot pin 22 is shown in a neutral position with the contact element 51 centered in the recess 22*b*. The bias provided by the biasing device 52 pushes the contact element 51 towards the pivot pin 22 so that the contact element 51 is brought into contact with a surface of the pivot pin 22 in the recess 22*b*. The centering device 50 is arranged on or in connection with that portion of the joint 20 that does not include the pivot pin 22, such as the joint head 21 as in previous embodiments described herein. In some embodiments, the centering device 50 may be configured in connection with another component mounted on the pivot pin 22, such as a cam disk that comprises the recesses shown and described herein.

FIG. 6*b* discloses the pivot pin 22 rotated in the clockwise direction. The contact element 51 is still pressed towards the recess 22*b* but the rotation has caused the contact element 51 to move in the radial direction away from the pivot pin 22, i.e. in the opposite direction of the first direction D. During a movement from the position shown in FIG. 6*a*, the contact element 51 has rolled or slid against the surface of the pivot pin 22 so that the position of FIG. 6*b* is reached. By the biasing force provided by the biasing device 52, the contact element 51 is urged in the first direction D which in turn causes the pivot pin 22 to return to the neutral position of FIG. 6*a*. This operation of a centering device is well known in the art.

By determining the position of the contact element 51 in the first direction D, it is possible to also determine the angular position of the pivot pin 22 by using information from the first sensor 31 together with information about dimensions of the contact element, as will be described in more detail below.

FIG. 6*c* discloses the pivot pin 22 rotated in the counter-clockwise direction so that the contact element 51 is pushed in the opposite direction to the first direction D. Similarly to the position shown in FIG. 6*b*, the contact element 51 strives to return to the neutral position by the bias applied by the biasing device 52, and by measuring or detecting the linear displacement of the contact element 51 in the first direction D, the angular position of the pivot pin 22 may be determined by processing circuitry 40. In some embodiments, the first sensor 31 may also be configured to detect a rotation of the contact element 51, and by determining a rotation from a neutral position the direction in which the pivot pin 22 has rotated to reach the angular position at any given time may be determined by processing circuitry 40.

In some embodiments, at least one additional centering device may be provided may be arranged in connection with the joint head 21 of the joint 20 and that may have a contact element that fits into another recess of the pivot pin 22. The additional centering device may be similar to the centering device 50 shown in FIG. 6*a*-6*c* or may have a different design, and in particular where dimensions of the contact element and/or the recesses of the pivot pin differ between the centering device and the additional centering device a measuring or detecting of a radial position of the contact elements may be used to determine both the angular position of the pivot pin 22 and the direction of rotation.

FIG. 7 discloses an angular position detection system 100 according to an embodiment of the invention, comprising the coupler 10, 10', 10" and the angular position detection assembly 30 with the first sensor 31 and the transmitter 32 that is configured to transmit signals from the first sensor 31 to processing circuitry 40 that also forms part of the system 100.

The processing circuitry 40 may suitably be operatively connected to a memory 41 from which information may be received or retrieved by the processing circuitry 40. Output means 42 may also be provided for presenting information from the processing circuitry 40 and/or memory 41 to a human operator.

Furthermore, a control unit 60 may be provided that comprises at least the processing circuitry 40 but optionally also other components such as the memory 41 and/or output means 42.

The method of determining the angular position of the front part 11 of the coupler 10, 10', 10" will now be described in more detail with reference to FIG. 8 onwards.

The method according to the present invention comprises providing 1001 the coupler 10, 10', 10" comprising the front part 11 and the rear part 12, and also comprising the rotatable joint 20 with the first portion 21, 23 and the second portion 22, 24 as disclosed above. The method also comprises providing 1002 the first sensor 31 arranged in connection with one of the first portion 21, 23 and the second portion 22, 24, and measuring or detecting 1003, by the first sensor 31, a parameter indicative of an angular position of the first portion 21, 23 of the joint 20 in relation to the second portion 21, 23 of the joint 20.

Suitably, the method also comprises providing 1004 processing circuitry 40 that is operatively connected to the first sensor 31, and receiving 1005, in said processing circuitry 40, at least one input signal from the first sensor 31 and determining 1006 the angular position of the front part 11 of the coupler 10, 10', 10" in relation to the rear part 12 of the coupler 10, 10', 10" based on said at least one input signal.

For each method embodiment described herein, the processing circuitry 40 preferably also determines the angular position based on additional information that is accessible to the processing circuitry 40, suitably by being stored in the memory 41. The additional information may comprise information regarding how the parameter measured or detected by the first sensor 31 relates to the angular position of the front end 11 of the coupler 10, 10', 10". Where the first sensor 31 is an optical sensor detecting markings on a marking surface, the additional information may include information stating which angular position that each marking on the marking surface corresponds to, so that the processing circuitry 40 is able to determine the angular position accurately in view of which marking is detected by the first sensor 31. Where the first sensor 31 is instead configured to detect or measure a distance d from the first sensor to a curved surface such as in the embodiments described above with the cam disk 33, the additional information may include information regarding which angular position of the pivot pin 22 in relation to the first sensor 31 corresponds to each value for the measured distance d. In the embodiments including the centering device 50, the additional information may instead be information regarding which angular position of the pivot pin 22 in relation to the centering device 50 itself that each position of the contact element 51 corresponds to. Alternatively, in embodiments including the centering device 50, the additional information may be information that relates to how the detected or measured parameter relates to the position of the contact element 51 itself, such as how a measured pressure in a chamber in connection with the piston 52*a* or how a measured compression or extension of the spring 52*b* relates to the position of the contact element 51. Thus, for each embodiment described herein, the additional information may comprise information that may be used by the processing circuitry 40 in combination with the at least one signal received from the first sensor 31 to determine the angular position of the first portion 21, 23 of the joint 20 in relation to the second portion 22, 24 of the joint 20 so that the angular position of the front part 11 in relation to the rear part 12 may thereby also be determined.

In some embodiments, however, the processing circuitry 40 may instead use only the at least one signal received from the first sensor 31 to determine the angular position of the front part 11 of the coupler 10, 10', 10".

In one embodiment suitable for a coupler 10' of the second type comprising an elastomer spring joint (EFG) as the joint 20, the method may comprise the steps shown in FIG. 9. In this embodiment, the method also comprises providing 1007 at least two sensors 31*a*, 31*b*, that comprise at least one first axis sensor 31*a* and at least one second axis sensor 31*b*. The first axis sensor 31*a* measures or detects 1008*a* parameter indicative of the angular position of the first portion 23 of the joint 20 in a plane of rotation that is perpendicular to the first axis (A), and the second axis sensor measures or detects 1009*a* parameter indicative of the angular position of the first portion 23 of the joint 20 in a plane of rotation that is perpendicular to a second axis (B). Also, this embodiment comprises receiving 1010, in processing circuitry 40, at least one first input signal from the first axis sensor (31*a*) and at least one second input signal from the second axis sensor (31*b*), and determining 1011, in processing circuitry 40, based on said at least one first input signal and said at least one second input signal, the combined angular position in relation to the first and the second axes of rotation A, B of the front part 11 of the coupler 10' in relation to the rear part 12 of the coupler 10'.

Optionally, both for embodiments where the angular position is determined and embodiments where the combined angular position is determined, the method may comprise determining 1017 whether the front part 11 of the coupler 10, 10', 10" is in a stowage position. This is suitably determined by comparing the angular position or combined angular position with information accessible to the processing circuitry 40 regarding a stowage position to check if the determined position corresponds to the stowage position. If the stowage position is not reached, the method may also include notifying an operator in any suitable way so that the position of the front end 11 can be corrected until the stowage position is reached. Alternatively, the method may include notifying the operator that the stowage position is reached, or a combination thereof.

In another embodiment, the method also comprises the processing circuitry receiving 1012 input signals indicative of the angular position at a plurality of time instances from either the first sensor 31 or from the axis sensor 31*a* and the axis sensor 31*b*. The method then comprises determining 1013 the angular position over time based on the signals from the first sensor 31 or the combined angular position over time based on the signals from the first axis sensor 31*a* and the second axis sensor 31*b*.

Based on the angular position over time or the combined angular position over time, the method may in some embodiments also include determining 1020 at least one wear related parameter of the coupler 10, 10', 10". This wear related parameter may be a total wear on the coupler 10, 10', 10" that occurs due to the angular displacement of the front part 11 or may instead be a time until maintenance is required or a remaining lifetime of the coupler 10, 10', 10" or any component of the coupler 10, 10', 10". Thus, the wear related parameter may also be determined for any pivotable components such as a gangway that is mounted on the coupler 10, 10', 10" and that pivots together with the coupler 10, 10', 10". In some embodiments, the wear related parameter may also or instead be determined based on a rate of change of the angular position over time or combined angular position over time so that the wear related parameter may be modified based on the speed of pivoting of the front end 11 rather than just on the angular positions or combined angular positions as such. The processing circuitry 40 may also access additional information in order to determine the wear related parameter, such as information regarding a usual wear associated with time spent in angular positions exceeding a given angular range close to the neutral position where the front end 11 is aligned with the rear end 12, or wear associated with pivoting at different rates for known durations of time. Other information may also be used in combination with the angular position over time, combined angular position over time, and rates of change thereof, in order to determine the wear related parameter.

In yet another embodiment, the determined angular position or combined angular position may be used by the processing circuitry 40 to determine 1021 if the front part 11 of the coupler is in a suitable coupling position. This may be achieved by combining the determined angular position or combined angular position with information accessible to the processing circuitry 40 regarding an angular range from the neutral position where coupling may take place. If it is determined that the position of the front part 11 is not in the suitable coupling position, the method may comprise determining 1022*a* correction of the angular position or the combined angular position that would bring the front part 11 to a position that is suitable for coupling, and the method may further comprise sending 1022 an output signal to a pivoting means comprised in the coupler 10, 10', 10" in order to apply the correction so that the front part 11 is brought into the suitable coupling position. The pivoting means may be automated so that the position of the front part 11 of the coupler is corrected in response to the output signal from the processing circuitry 40, but optionally the correction could instead be applied manually in response to the determined correction or even in response to information presented to or accessible to the operator that the coupler is not in the suitable coupling position.

In some embodiments, the method also includes receiving 1023, in processing circuitry, at least one second coupler input signal indicative of an angular position of a front part of a second coupler, and determining, in processing circuitry, if the front part of the second coupler is in a suitable coupling position based on said second coupler input signal. If it is determined that the second coupler is not in the suitable coupling position, a correction is then determined 1024 and a correction may be applied 1025 so that the second coupler is pivoted automatically or by a manual operator in order to reach the suitable coupling position.

In some embodiments, the angular position or combined angular position of both the front part 11 of the coupler 10, 10', 10" and of the second coupler may be used to determine if they are both in a suitable coupling position in relation to each other. This may be achieved by determining if they are both in angular positions that are considered to fall within the range of the suitable coupling positions for each coupler individually, but may alternatively also or instead be determined by using their angular positions or combined angular positions in relation to each other to see how they together deviate from the neutral position and determine if the deviation renders them suitable for coupling to each other. Also, the method may then comprise applying a correction to either of the coupler 10, 10', 10" and the second coupler or to both in order to bring them into suitable coupling positions in relation to each other.

In another embodiment shown in FIG. 12, the method comprises providing 1026*a* plurality of interconnected railway vehicles that are joined to each other by couplers to form a train, and providing 1027, in each coupler of the interconnected railway vehicles, first sensor 31 arranged in connection with a joint 20 rotatably connecting a front part of the coupler to a rear part of the coupler. In this embodiment, the method also comprises measuring or detecting 1028, by said first sensor 31 in each coupler of the interconnected railway vehicles, a parameter indicative of the angular position of the first portion 21, 23 of the joint 20 in relation to the second portion 22, 24 of the joint 20. The first sensor 31 may be provided according to any of the embodiments shown above.

In this method embodiment, the method also comprises the processing circuitry 40 receiving 1029 signals from each of the first sensors 31 on the plurality of couplers 10, 10', 10" of the interconnected railway vehicle and these signals are indicative of the measured or detected parameter as described above. The method then also comprises determining 1030 for each of the couplers 10, 10', 10" the angular position or combined angular position of the front part 11 in relation to the rear part 12, and also comprises determining 1031*a* curvature of the train. Optionally, the method also includes determining 1032 curvature of the train over time and this can be achieved by repeating the steps shown in FIG. 12 for a plurality of different points of time, or using the determined angular position or combined angular position over time as described above. The curvature or curvature over time may also be combined with additional information accessible to the processing circuitry in order to compare with known maps of tracks or to generate maps or update existing maps.

In some method embodiments concerning the foldable coupler 10''', the method also comprises providing, in the coupler 10", the midway joint 20' that joins the first section 11*a* of the front part 11 to a second section 11*b* of the front part 11. The midway joint comprises the first midway joint portion 21' comprised in the first section 11*a* and the second midway joint portion 22' comprised in the second section 11*b*. That the first midway joint portion 21' is comprised in the first section 11*a* is to be understood as the first midway joint portion 21' being mounted, attached or arranged in connection with the first section 11*a*, or alternatively that the first midway joint portion 21' is integrated with the first section 11*a*. Similarly, the second midway joint portion 22' is mounted, attached or arranged in connection with the second section 11*b*, or alternatively integrated with the second section 11*b*.

The method in such embodiments also comprises providing a first midway joint sensor 31 arranged in connection with one of the first midway joint portion 21' and the second midway joint portion 22', further comprises measuring or detecting, by the first midway joint sensor 31, a parameter indicative of an angular position of the first midway joint portion of the midway joint in relation to the second midway joint portion of the midway joint. In this way, the inventive method can be used to determine the angular position of the first section 11*a* in relation to the second section 11*b* in a manner similar or identical to the manner of determining the angular position of the front part 11 in relation to the rear part 12.

In an aspect of the invention there is provided a non-transitory computer-readable storage medium storing instructions which, when executed by processing circuitry 40 of an angular position detection system 100, cause the system 100 to perform steps of any of the methods disclosed herein.

The non-transitory computer-readable storage medium may further store instruction which, when executed by the processing circuitry 40, cause the angular position detection system 100 to perform the method steps of any of the embodiments described herein.

Although embodiments of the invention described above comprise processing circuitry 40 that is suitably comprised in a control unit 60, the invention also extends to computer programs, particularly computer programs on or in a carrier, adapted for putting the invention into practice. The programs may be in the form of source code, object code, a code intermediate source and object code such as in partially compiled form, comprise software or firmware, or in any other form suitable for use in the implementation of the process according to the invention. The program may either be a part of an operating system, or be a separate application. The carrier may be any entity or device capable of carrying the program. For example, the carrier may comprise a storage medium, such as a Flash memory, a ROM (Read Only Memory), for example a DVD (Digital Video/Versatile Disk), a CD (Compact Disc) or a semiconductor ROM, an EPROM (Erasable Programmable Read-Only Memory), an EEPROM (Electrically Erasable Programmable Read-only Memory), or a magnetic recording medium, for example a floppy disc or hard disc. Further, the carrier may be a transmissible carrier such as an electrical or optical signal which may be conveyed via electrical or optical cable or by radio or by other means. When the program is embodied in a signal which may be conveyed directly by a cable or other device or means, the carrier may be constituted by such cable or device or means. Alternatively, the carrier may be an integrated circuit in which the program is embedded, the integrated circuit being adapted for performing, or for use in the performance of, the relevant processes.

In one or more embodiments, there may thus be provided a computer program loadable into a memory communicatively connected or coupled to at least one data processor, e.g. the control unit 60, comprising software or hardware for executing the method according any of the embodiments herein when the program is run on the at least one data processor.

In one or more further embodiments, there thus also may be provided a processor-readable medium, having a program recorded thereon, where the program is to make at least one data processor, e.g. the control unit 60, execute the method according to of any of the embodiments herein when the program is loaded into the at least one data processor.

It is to be noted that features from the various embodiments described herein may freely be combined, unless it is explicitly stated that such a combination would be unsuitable.

The invention claimed is:

1. Coupler with an angular position detection assembly for determining an angular position of a front part of the coupler, wherein the coupler (10, 10', 10") comprises:

a front part (11) for coupling to another coupler, a rear part (12) for mounting on an end of a car of a railway vehicle, a rotatable joint (20) comprising a first portion (21, 23) and a second portion (22, 24), said first portion being rotatably attached to the second portion, wherein the first portion (21, 23) of the joint is attached to the front part (11) and the second portion (22, 24) of the joint is attached to the rear part (12) so that the front part (11) of the coupler (10, 10', 10") is able to rotate in relation to the rear part (12), and wherein the angular position detection assembly (30) comprises a first sensor (31) arranged in connection with one of the first portion (21,23) and the second portion (22, 24) and configured to detect or measure a parameter indicative of an angular position of the first portion (21, 23) in relation to the second portion (22, 24), and a transmitter (32) configured to receive signals from the first sensor and further configured to transmit said signals to processing circuitry for determining the angular position of the front part of the coupler in relation to the rear part of the coupler, wherein the angular position detection assembly comprises a curved surface mounted on one of the first portion (21, 23) and the second portion (22, 24), and wherein the first sensor (31) is mounted on the other of the first and second portion, and wherein the curved surface is arranged so that a distance between the first sensor and a closest point on the curved surface in a radial direction varies when the first portion rotates in relation to the second portion, said radial direction being a direction that is perpendicular to a rotational axis of the joint, and wherein further the first sensor is configured to detect or measure a distance from the first sensor to the curved surface.

2. Coupler with an angular position detection assembly according to claim 1, wherein the joint (20) is an elastomer spring joint, the first sensor (31) is a first axis sensor (31*a*) configured to detect or measure a parameter indicative of an angular position in a plane of rotation that is perpendicular to a first axis (A).

3. Coupler with an angular position detection assembly according to claim 1, wherein the joint (20) comprises a joint head and a pivot pin arranged in a holder (25), the joint head being arranged on the pivot pin to rotate about a first axis (A) and one of the joint head and the pivot pin forming the first portion (21) of the joint (20) and the other of the joint head and the pivot pin forming the second portion (22) of the joint (20), and wherein the first sensor (31) is arranged in connection with one of the joint head and the pivot pin and configured to detect or measure a rotation about the first axis (A) of the joint head in relation to the pivot pin.

4. Coupler with an angular position detection assembly according to claim 3, wherein the angular position detection assembly comprises a curved surface mounted on one of the first portion (21, 23) and the second portion (22, 24), the first sensor (31) is mounted on the other of the first and second portion, the curved surface is arranged so that a distance between the first sensor and a closest point on the curved surface in a radial direction varies when the first portion rotates in relation to the second portion, said radial direction being a direction that is perpendicular to a rotational axis of the joint, the first sensor is configured to detect or measure a distance from the first sensor to the curved surface, the curved surface forms an edge (35) of a cam disk (33) that is fixedly mounted on the pivot pin (22), and the first sensor is mounted on a structure connected to the joint head (21) and facing the edge (35) of the cam disk (33).

5. Coupler with an angular position detection assembly according to claim 3, wherein the coupler further comprises at least one centering device (50) that is arranged in connection with the joint head (21), said at least one centering device comprising a contact element (51) that is biased towards the pivot pin (22) in a radial direction of the pivot pin (22), wherein the contact element (51) is at a variable distance from a center of the pivot pin (22) depending on an angular position of the pivot pin (22) in relation to the joint head (21), and wherein the first sensor (31) of the angular position detection assembly (30) is configured to detect or measure a parameter that is indicative of a radial position of the contact element (51).

6. Coupler with an angular position detection assembly according to claim 1, wherein the first sensor (31) is configured to detect at least one marker on a marking surface, wherein the first sensor is arranged on one of the first portion (21, 23) and the second portion (22, 24) and the marking surface is a surface on the other of the first and second portion, said marking surface being arranged to face the first sensor.

7. Angular position detection system for a railway coupler, the angular position detection system comprising a coupler with an angular position detection assembly according to claim 1, processing circuitry (40) operatively connected to the transmitter of the first sensor (31) of the angular position detection assembly (30) for receiving at least one signal indicative of the detected or measured parameter, and wherein the processing circuitry (40) is further configured to receive, from the first sensor (31), at least one input signal indicative of an angular position of the first portion (21, 23) of the joint (20) in relation to the second portion (22, 24) of the joint (20), and determine, based on said at least one input signal, an angular position of the front part (11) of the coupler (10, 10', 10") in relation to the rear part (12) of the coupler (10, 10', 10").

8. Method for determining an angular position of a front part of a coupler, comprising providing (1001) a coupler (10, 10', 10") comprising a front part (11) for coupling to another coupler, a rear part (12) for mounting on an end of a car of a railway vehicle, and also comprising a rotatable joint (20), wherein the rotatable joint (20) comprises a first portion (21, 23) and a second portion (22, 24), said first portion (21, 23) being rotatably attached to the second portion (22, 24), wherein the first portion (21, 24) of the joint (20) is attached to the front part (11) and the second portion (22, 24) of the joint (20) is attached to the rear part (12) so that the front part (11) of the coupler (10, 10', 10") is able to rotate in relation to the rear part (12), providing (1002) a first sensor (31) arranged in connection with one of the first portion (11) and the second portion (12), providing a curved surface mounted on one of the first portion (21, 23) and the second portion (22, 24), and wherein the first sensor (31) is mounted on the other of the first and second portion, and wherein the curved surface is arranged so that a distance between the first sensor and a closest point on the curved surface in a radial direction varies when the first portion rotates in relation to the second portion, said radial direction being a direction that is perpendicular to a rotational axis of the joint, and wherein further the first sensor is configured to detect or measure a distance from the first sensor to the curved surface, and measuring or detecting (1003), by the first sensor, a parameter indicative of an angular position of the first portion (21, 23) of the joint (20) in relation to the second portion (22, 24) of the joint (20).

9. Method according to claim 8, further comprising providing (1004) processing circuitry (40) operatively connected to the first sensor (31) for receiving signals from the first sensor (31), receiving (1005), in processing circuitry (40), at least one input signal from the first sensor (31) indicative of an angular position of the first portion (21, 23) of the joint in relation to the second portion (22, 24) of the joint, and determining (1006), based on said at least one input signal, an angular position of the front part (11) of the coupler in relation to the rear part (12) of the coupler.

10. Method according to claim 9, further comprising providing (1007) at least two sensors that comprise at least one first axis sensor (31*a*) and at least one second axis sensor (31*b*), measuring or detecting (1008), by said first axis sensor (31*a*), a parameter indicative of an angular position of the first portion in a plane of rotation that is perpendicular to a first axis (A), measuring or detecting (1009), by said second axis sensor (31*b*), a parameter indicative of an angular position of the first portion (21, 23) in a plane of rotation that is perpendicular to a second axis (B), said second axis (B) being perpendicular to the first axis (A), receiving (1010), in processing circuitry, at least one first input signal from the first axis sensor (31*a*) and at least one second input signal from the second axis sensor (31*b*), wherein said first and second input signals are indicative of the measured or detected parameter from the first axis sensor (31*a*) and the second axis sensor (31*b*), and determining (1011), in processing circuitry, based on said at least one first input signal and said at least one second input signal, a combined angular position in relation to the first and the second axes (A, B) of rotation of the front part (11) of the coupler in relation to the rear part (12) of the coupler.

11. Method according to claim 9, further comprising receiving (1018), in processing circuitry, from either the first sensor (31) or a first axis sensor (31*a*) and a second axis sensor (31*b*), input signals indicative of an angular position at a plurality of time instances, and determining (1019), in processing circuitry, either an angular position or a combined angular position of the front part (11) of the coupler over time based on said input signals.

12. Method according to claim 9, further comprising determining (1021), in processing circuitry, based on the determined angular position or a determined combined angular position, if the front part (11) of the coupler is in a suitable coupling position.

13. Method according to claim 12, further comprising receiving (1023), in processing circuitry, at least one second coupler input signal indicative of an angular position of a front part of a second coupler, and determining (1024), in processing circuitry, if the front part of the second coupler is in a suitable coupling position based on said second coupler input signal.

14. Method according to claim 13, further comprising determining (1022, 1024), in processing circuitry, a correction of an angular position of the front part of the coupler and/or the front part of the second coupler.

* * * * *